US012653247B2

(12) United States Patent
Marshall

(10) Patent No.: US 12,653,247 B2
(45) Date of Patent: Jun. 16, 2026

(54) WEARABLE BLANKET AND METHOD OF USING THE SAME

(71) Applicant: Sarah Gene Marshall, Williams Bay, WI (US)

(72) Inventor: Sarah Gene Marshall, Williams Bay, WI (US)

(73) Assignee: Sarah Gene Marshall, Williams Bay, WI (US)

( * ) Notice: Subject to any disclaimer, the term of this patent is extended or adjusted under 35 U.S.C. 154(b) by 0 days.

(21) Appl. No.: 18/807,641

(22) Filed: Aug. 16, 2024

(65) Prior Publication Data

US 2025/0057258 A1 Feb. 20, 2025

Related U.S. Application Data

(60) Provisional application No. 63/588,069, filed on Oct. 5, 2023, provisional application No. 63/520,216, filed on Aug. 17, 2023.

(51) Int. Cl.
*A41B 13/06* (2006.01)

(52) U.S. Cl.
CPC ..... *A41B 13/06* (2013.01)

(58) Field of Classification Search
CPC ..... A41B 13/06; A41B 13/04; A41D 11/00
USPC ..... 2/69.5
See application file for complete search history.

(56) References Cited

U.S. PATENT DOCUMENTS

| | | | | |
|---|---|---|---|---|
| 1,502,608 | A | 7/1924 | Young | |
| 2,325,097 | A | 7/1943 | Behringer | |
| 2,469,556 | A | 5/1949 | Jacobson | |
| 2,563,501 | A | 8/1951 | Sperling | |
| 2,643,398 | A | 6/1953 | Routman | |
| 2,908,912 | A | 10/1959 | Darling | |
| 2,989,753 | A | 6/1961 | Burner | |
| 4,295,230 | A | 10/1981 | Blodgett | |
| 4,597,121 | A | 7/1986 | Bouma | |
| 5,416,938 | A | 5/1995 | Li | |
| 6,266,822 | B1 | 7/2001 | Joyce | |
| 7,337,482 | B2 | 3/2008 | Byrne | |
| 9,179,712 | B2 | 11/2015 | Jaggernauth | |
| RE48,330 | E * | 12/2020 | Zeidman | A47G 9/083 |
| 2007/0056098 | A1* | 3/2007 | Schmid | A41B 13/06 2/69.5 |
| 2007/0094795 | A1 | 5/2007 | Byrne | |
| 2008/0184486 | A1 | 8/2008 | Byrne | |
| 2010/0024092 | A1 | 2/2010 | Finell | |
| 2010/0170039 | A1* | 7/2010 | Davis | B60N 2/2881 5/494 |
| 2012/0311762 | A1* | 12/2012 | Aiken | A41B 13/06 2/69.5 |

(Continued)

FOREIGN PATENT DOCUMENTS

WO 2007040495 A1 4/2007

OTHER PUBLICATIONS

"Summer ComfortMe Wearable Blanket, Happy Floral, Large." Summer Infant Store, Mar. 6, 2025, https://www.amazon.com/Summer-Infant-ComfortMe-Wearable-Blanket/dp/B00HG692FK.

*Primary Examiner* — Timothy K Trieu
(74) *Attorney, Agent, or Firm* — Cook Alex Ltd.

(57) ABSTRACT

A wearable blanket assembly that includes a piece of fabric attached to a body suit and a method of wrapping an infant in the wearable blanket assembly. In particular, a customizable wearable blanket assembly and method of using the same.

20 Claims, 21 Drawing Sheets

(56) References Cited

U.S. PATENT DOCUMENTS

| | | | | |
|---|---|---|---|---|
| 2015/0101100 | A1 | 4/2015 | Flowers | |
| 2015/0237934 | A1* | 8/2015 | Kirkland | A41D 13/1281 2/455 |
| 2019/0208831 | A1* | 7/2019 | Joshi | A41D 15/002 |

* cited by examiner

WEARABLE BLANKET AND METHOD OF USING THE SAME

CROSS-REFERENCE TO RELATED APPLICATIONS

The present application claims the benefit of and priority to U.S. Provisional Application No. 63/520,216 filed Aug. 17, 2023, and U.S. Provisional Application No. 63/588,069 filed Oct. 5, 2023, the disclosures of which are hereby incorporated herein by reference.

FIELD OF THE DISCLOSURE

The present disclosure relates to blankets for keeping a child warm, and more specifically to a one-piece wearable blanket assembly that includes a body suit having a piece of fabric (e.g., blanket, sheet, and covers) attached to the body suit.

BACKGROUND

One problem associated with sleeping children, and in particular infants, is that the child pulls or kicks the blanket off her/his body while sleeping. Several children are comforted or soothed by the feeling of being covered by a blanket and when they kick or pull the blanket off their body, the child often times awakens from her/his sleep. In a worst-case scenario, the child pulls the blanket over her/his head resulting in a risk of suffocation. This can cause stress and anxiety for parents of young children.

SUMMARY

In one aspect, a wearable blanket assembly is provided. The wearable blanket assembly includes a body suit with an openable fastener element configured to be opened for placing the body suit on a child and a piece of fabric having dimensions larger than that of the body suit, the piece of fabric being releasably attached to the body suit.

In accordance with another aspect of the present subject matter, a customizable, wearable blanket assembly is provided. The customizable, wearable blanket assembly includes a body suit and a fabric including a fabric first side and a fabric second side. The fabric second side is attached to the body suit. Additionally, the fabric includes a plurality of attachment elements configured to hold the fabric in a variety of configurations.

In accordance with another aspect of the present subject matter, a method of wrapping an infant in a one-piece sleepwear blanket including a unitary body suit and a piece of fabric having dimensions larger than that of the body suit, the piece of fabric being permanently attached to the body suit is provided. The method includes placing the infant in the body suit, wrapping a first segment of the piece of fabric around one of a right side and a left side of the infant, and wrapping a second segment of the piece of fabric around the other of the right side and the left side of the infant, thereby wrapping the infant.

These and other aspects are found in the drawings hereof and the detailed description below.

DETAILED DESCRIPTION OF DRAWINGS

DETAILED DESCRIPTION

Figure 1:
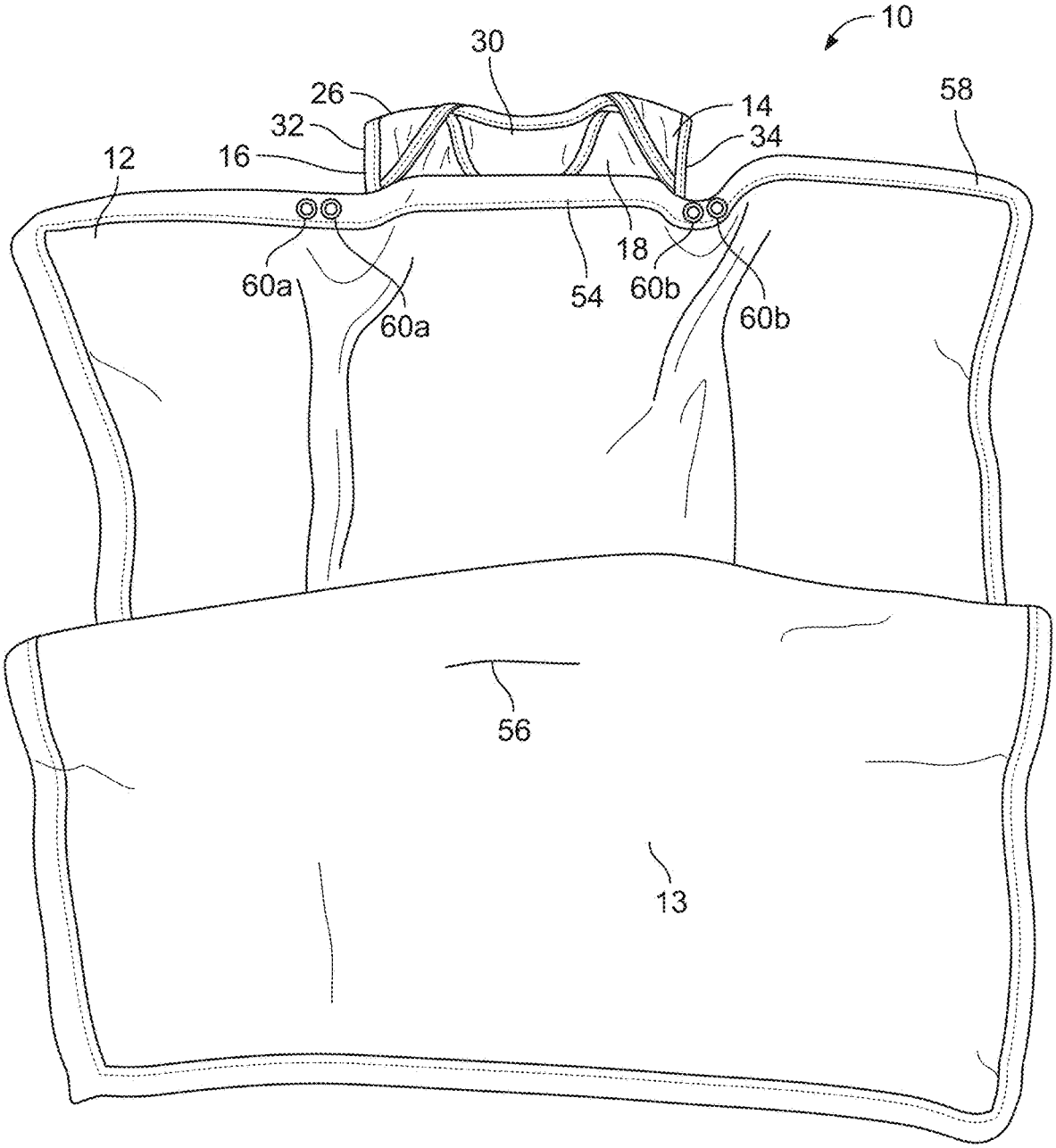
FIG. 1 is a front perspective view that shows one embodiment of a wearable blanket assembly of the present disclosure.
Figure 2:
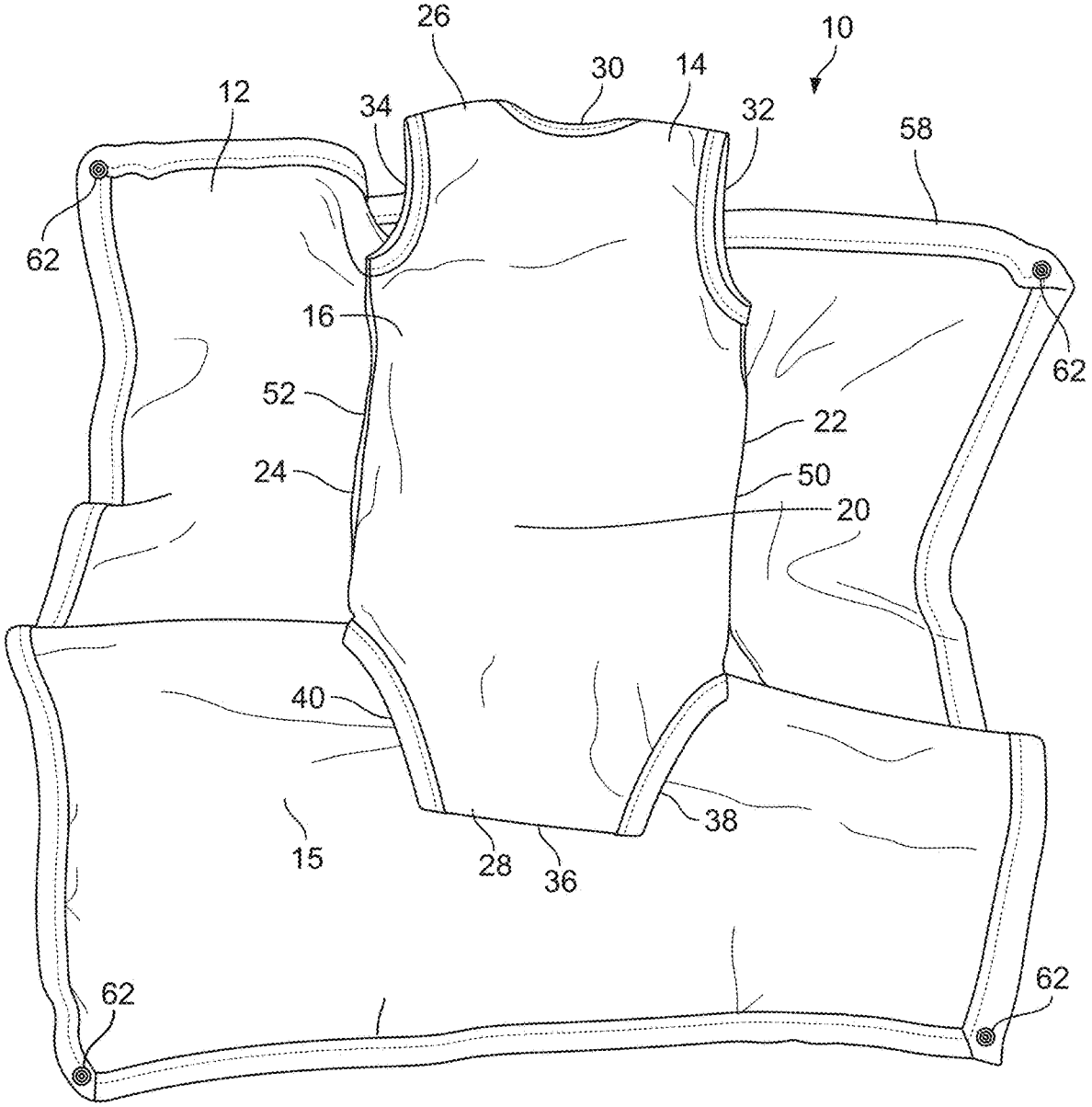
FIG. 2 is a rear perspective view of the wearable blanket assembly of FIG. 1.

FIGS. 1 and 2 depict one non-limiting example of the wearable blanket assembly 10 of the present disclosure. Blanket assembly 10 includes a piece of fabric 12 (blanket or blanket portion, these terms may be used interchangeably) and a body suit 14, which are attached or connected to one another. Piece of fabric 12 and body suit 14 can be releasably attached to one another or they could be permanently attached to one another. Fabric 12 and body suit 14 may be permanently attached by, for example, stitching, unitary construction, adhesive, iron-on or the like. Alternatively, fabric 12 and body suit 14 may be releasably attached by an attachment mechanism/member, such as zippers, hook-and-loop, buttons, snaps or the like.

Figure 15:
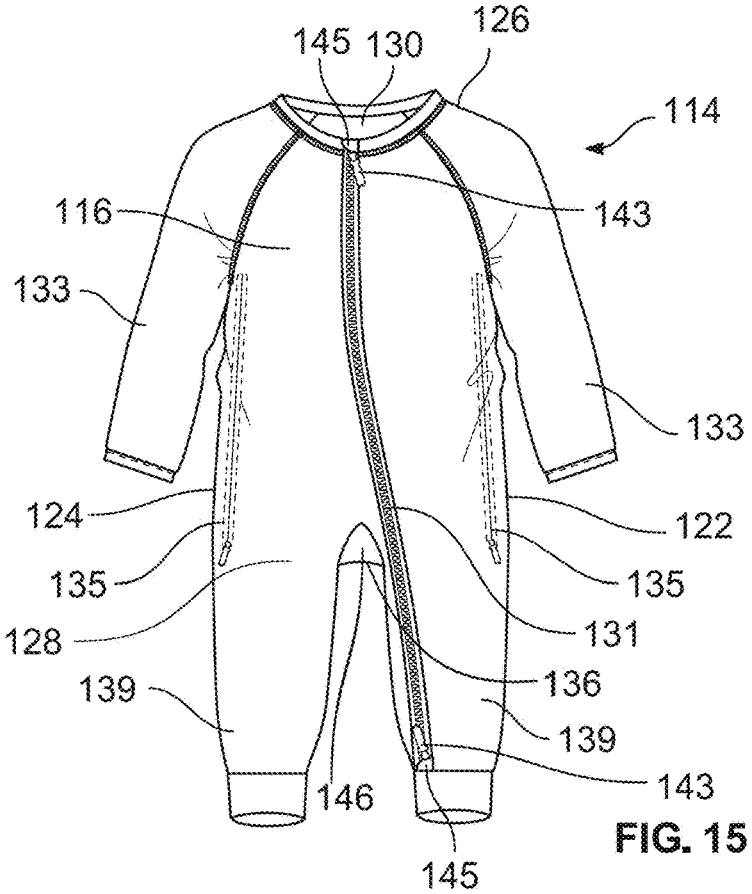
FIG. 15 is a front view of an embodiment of a body suit.
Figure 16:
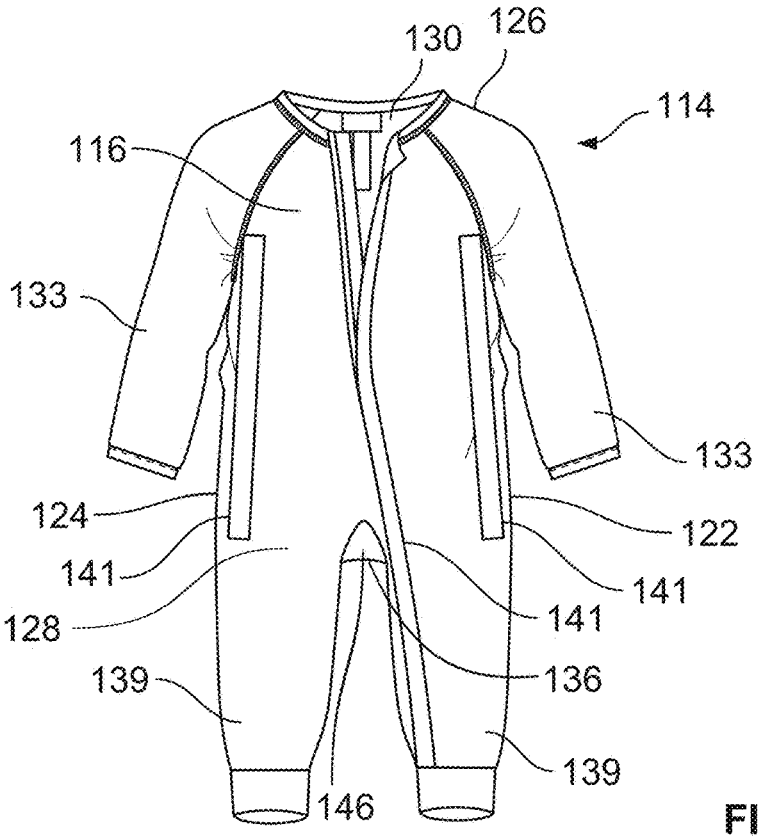
FIG. 16 is a front view of another embodiment of a body suit.
Figure 18:
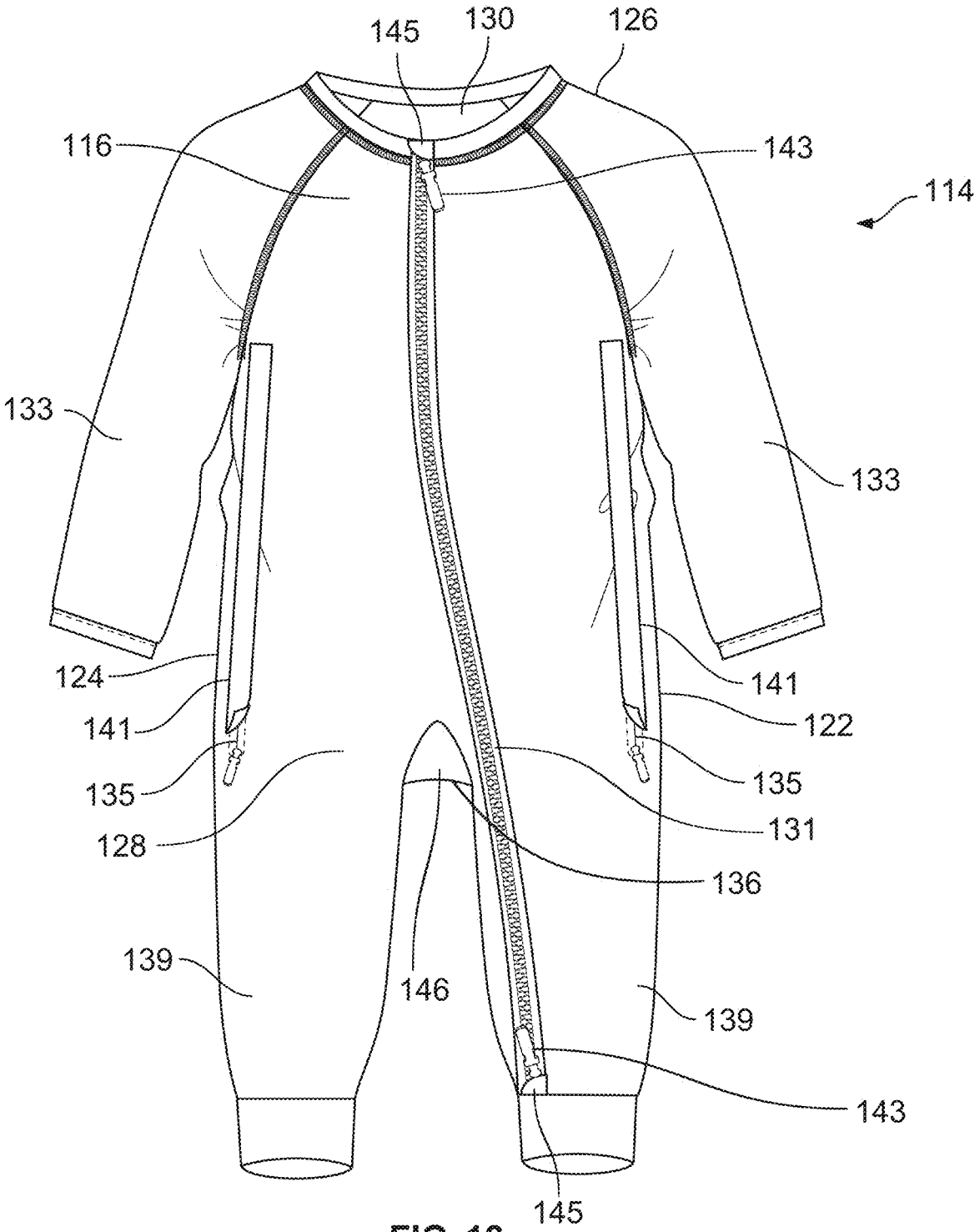
FIG. 18 is a front view of another embodiment of a body suit.

Body suit 14 may be any type of a body suit. Preferably, body suit 14 is one for a young child or infant. Also, the body suit may come in different sizes to fit children of different sizes and/or to provide different sizes as the child grows. Blanket assembly 10, and thus the body suit 14, may be the primary garment, i.e., the only garment worn by the child with no undergarments other than a diaper, when a diaper is worn by an infant. In other instances, blanket assembly 10, and thus body suit 14, may be a secondary garment worn over a primary garment, e.g., worn over pajamas or other clothes. In the illustrated embodiment, body suit 14 is shown as sleeveless and without pant legs. However, and as explained in more detail below, body suit 14 may include sleeves and pant legs as shown in FIGS. 15-16 and 18.

Figure 5A:
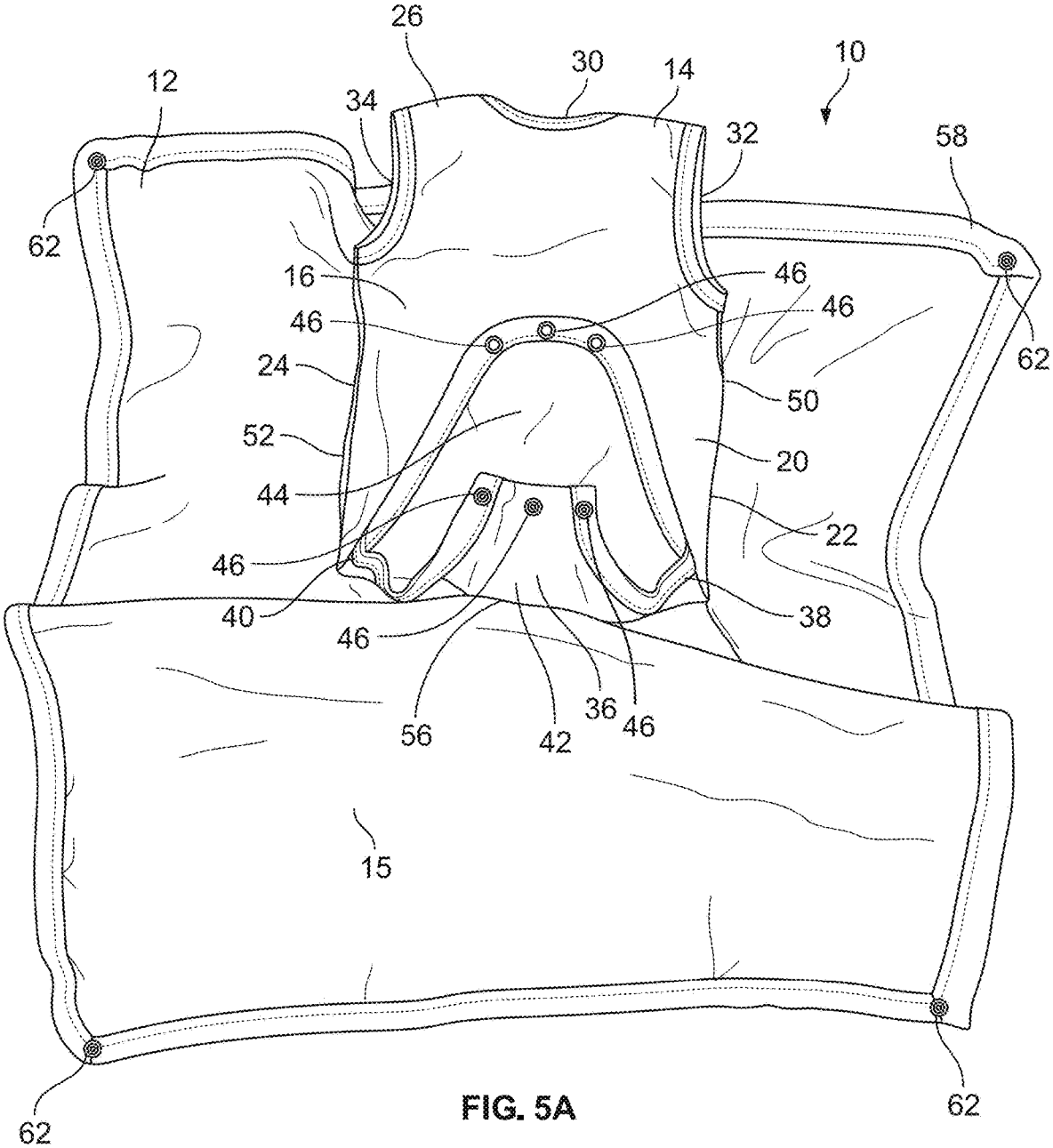
FIG. 5A is a rear perspective view of the wearable blanket assembly of FIG. 1 with the rear flap of the crotch in an open position.
Figure 5B:
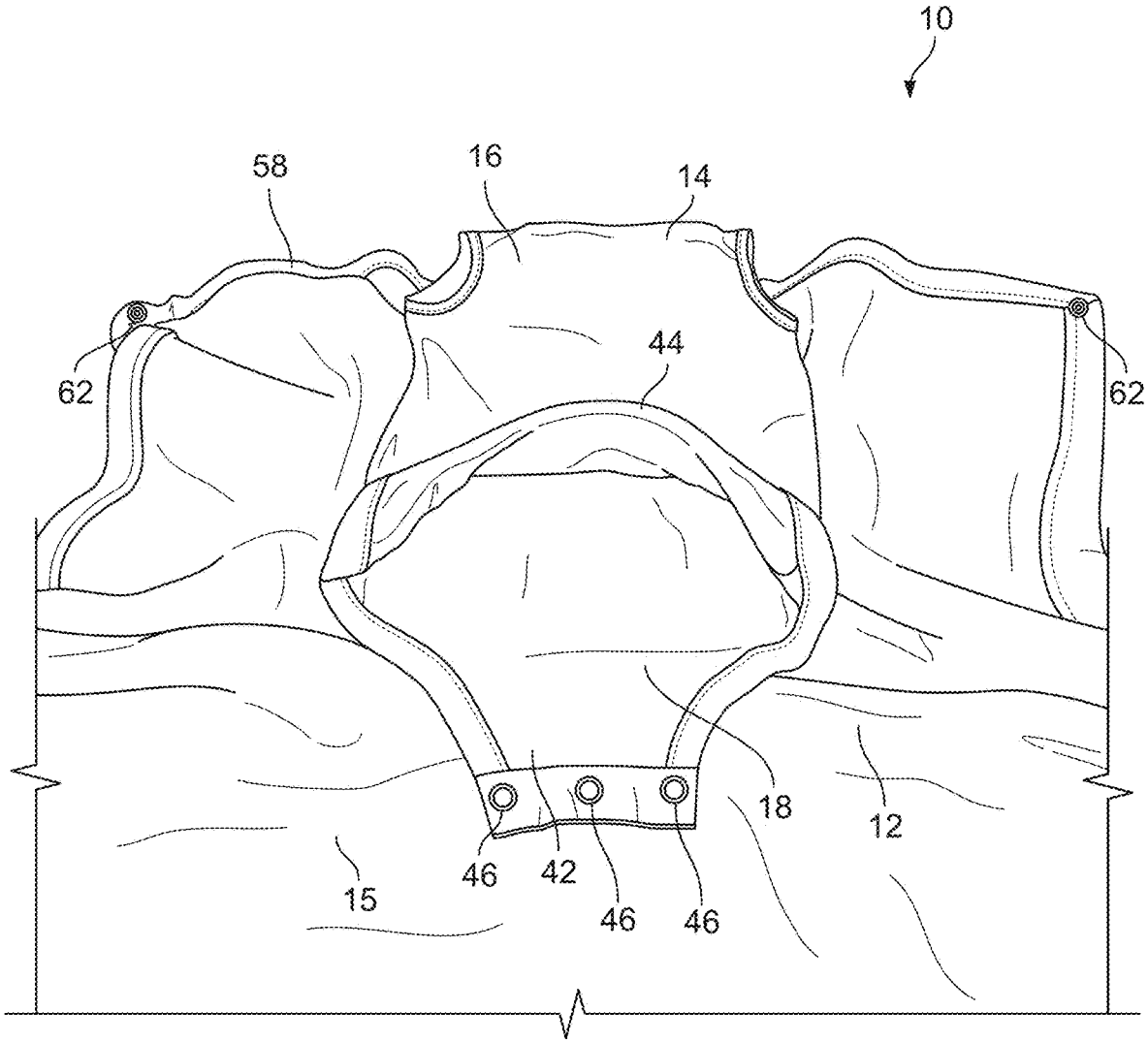
FIG. 5B is a perspective view of the bottom of the wearable blanket assembly of FIG. 1.

Body suit 14 may include a garment body 16 that has a front or front panel 18 (partially shown in FIG. 5B) and an opposed rear or rear panel 20, opposed sides 22 and 24, and opposed upper and lower ends 26 and 28. As shown in FIG. 5B, front panel 18 may abut fabric 12, or in an alternative embodiment shown in FIGS. 7-9, fabric 12 may at least partially define front panel 18. Front and rear panels 18 and 20, and sides 22 and 24 extend from upper end 26 of garment body 16 to lower end 28 of garment body 16 to define a volume to receive a torso or trunk of a child or infant.

A neck-receiving opening 30 is formed in upper end 26 of garment body 16, and opposed arm stalls 32 and 34 are formed in upper end 26 of garment body 16 on either side, respectively, of neck-receiving opening 30. A crotch 36 is formed in lower end 28 of garment body 16. Leg stalls 38 and 40 are formed in lower end 28 of garment body 16 on either side, respectively, of crotch 36.

Figure 3:
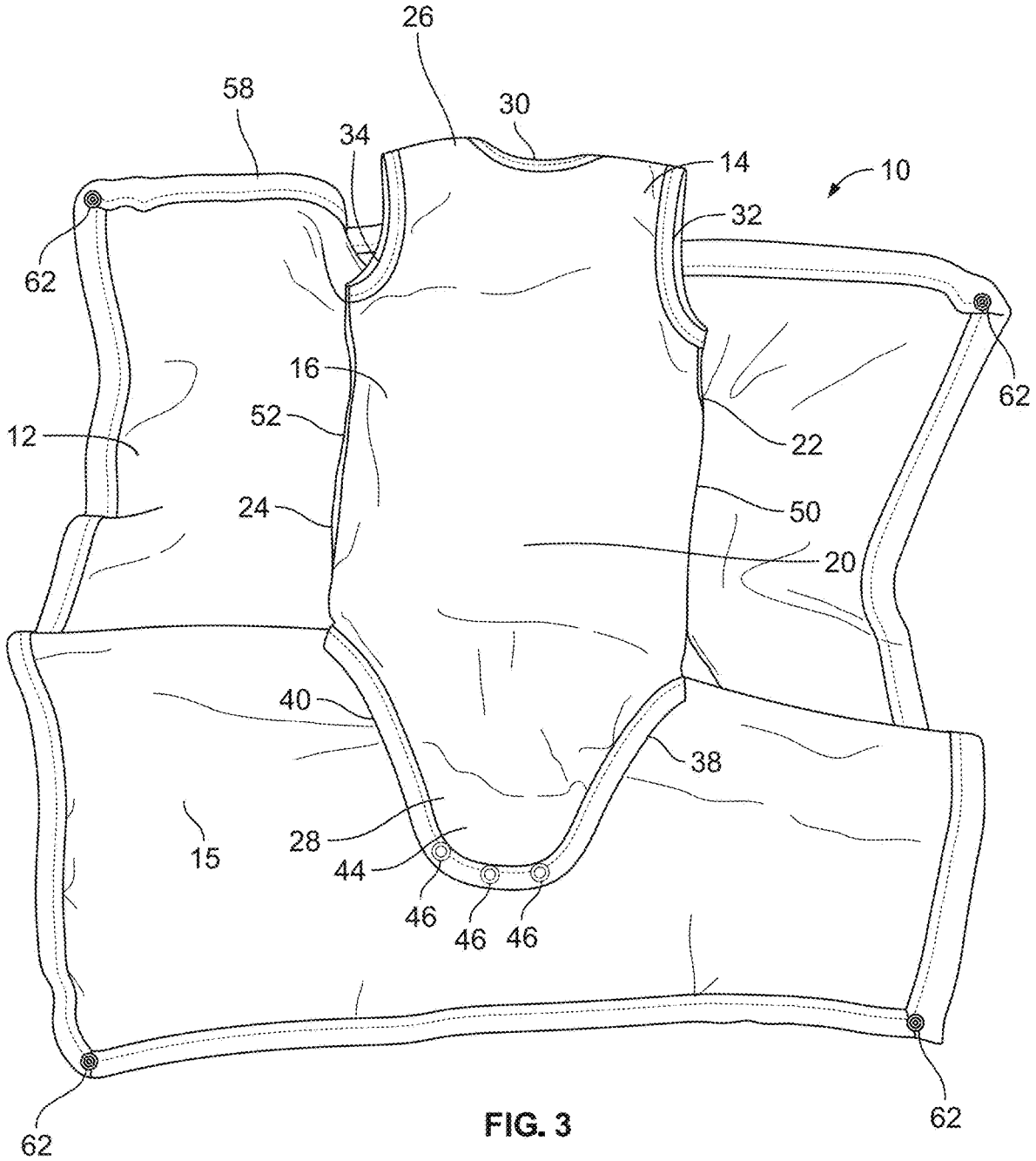
FIG. 3 is a rear perspective view of the wearable blanket assembly of FIG. 1 with the rear flap of the crotch in an open unattached position.
Figure 6:
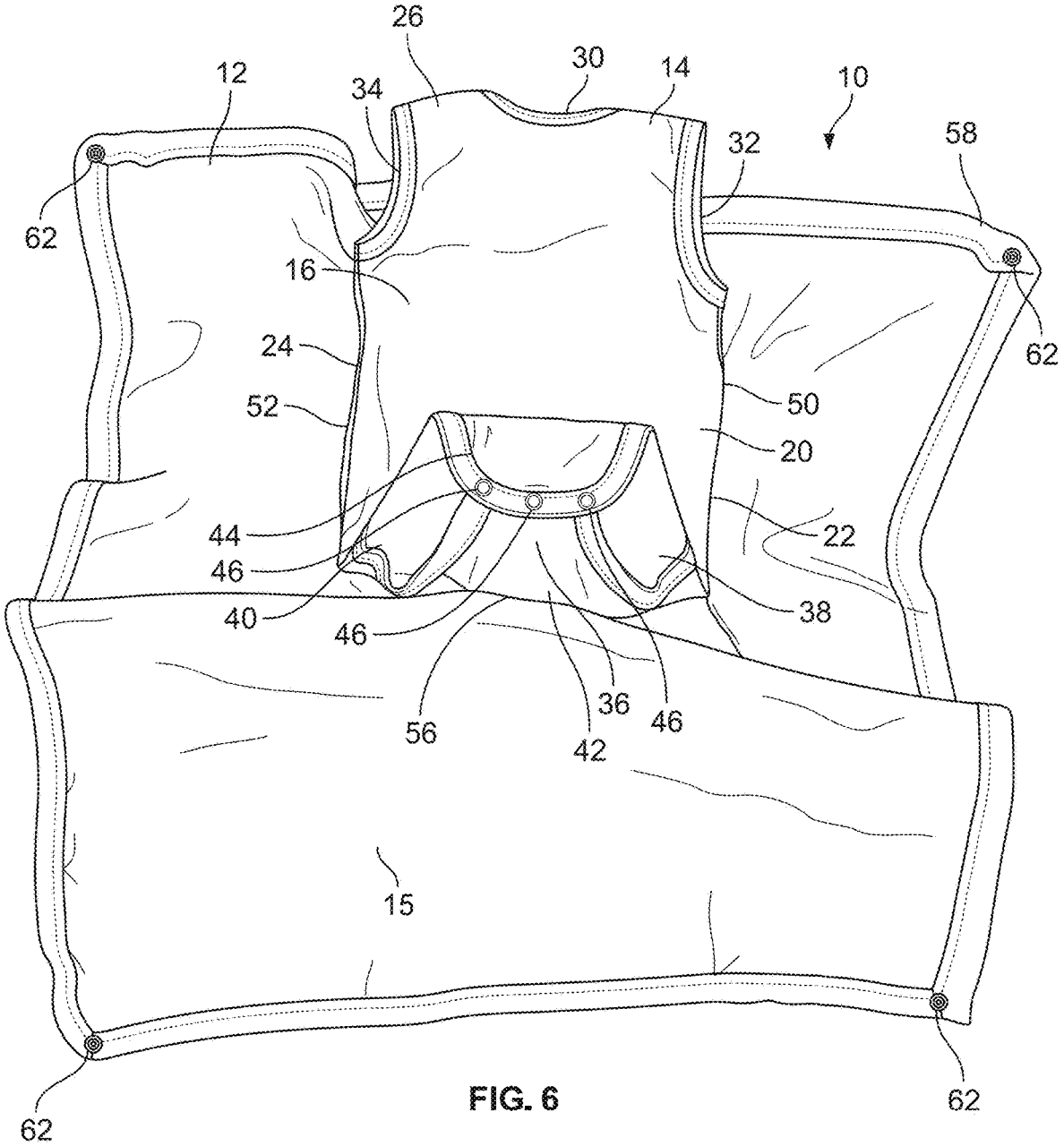
FIG. 6 is a rear perspective view of the wearable blanket assembly of FIG. 1 with the rear flap of the crotch in a closed position.

In the illustrated embodiment, crotch 36 is openable and provides an opening for receiving the torso of a child into the garment body 16. Referring to FIGS. 3, 5A and 6, crotch 36 includes a front flap 42 and a rear flap 44 which are releasably connectable to each other to close the crotch and secure the child in garment body 16. In the illustrated embodiment, front and rear flaps 42 and 44 are connected by crotch snaps 46. In other embodiments, the front and rear flaps 42 and 44 may be releasably connected by other releasable connectors, such as buttons, zippers, hook and eye, hook-and-loop, etc.

In the embodiment shown in FIGS. 1-6, garment body 16 is sleeveless and does not include pant legs. Arm stalls 32 and 34 each include an opening which receives an arm of a child when the garment body 16 is placed on the child. Leg stalls 38 and 40 each receive a leg when the front and rear flaps 42 and 44 of crotch 36 are connected. In other embodiments, arm stalls 32 and 34 could include short or long sleeves that cover the arms of the child. Additionally, garment body 16 could include short or long pant legs that cover the legs of the child. For example, as shown in FIGS. 15-16 and 18, garment body 116 includes sleeves 133 and pant legs 139.

Referring back to FIG. 1, piece of fabric 12 can be permanently connected to body suit 14 such that piece of fabric 12 covers the front of the child. Particularly, piece of fabric 12 includes a fabric first side 13 and a fabric second side 15 (shown in FIGS. 2-3 and 5A-6), and fabric second side can be permanently connected to body suit 14. Piece of fabric 12 may be any suitable fabric, including but not limited to, fleece, quilt or light cotton bed sheet type of material. Preferably, the fabric is larger in dimensions than garment body 16 and extends beyond each side 22 and 24 and below the lower end 28 of the garment body 16. Additionally, piece of fabric 12 may be any suitable shape, such as rectangular, circular, etc.

Figure 4:
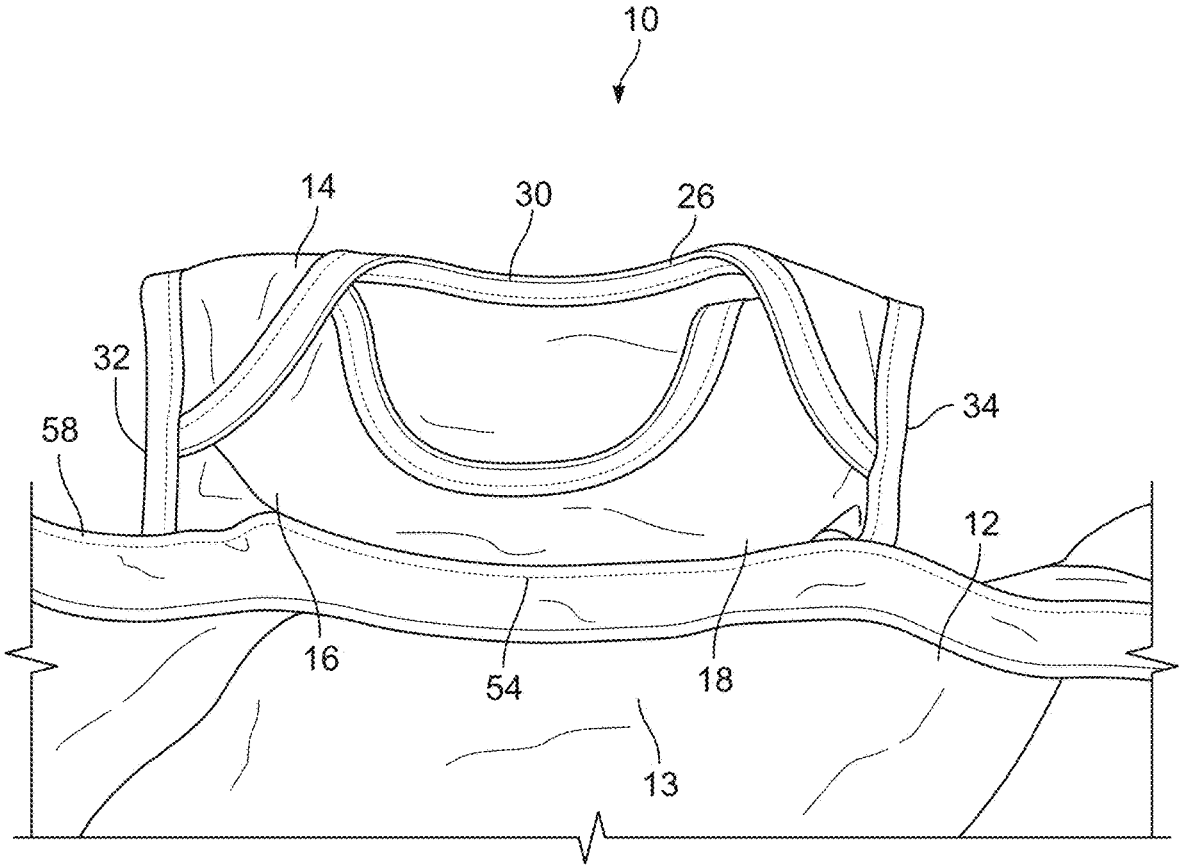
FIG. 4 is partial front perspective view of the wearable blanket assembly of FIG. 1 showing the top end of the wearable blanket assembly.
Figure 10:
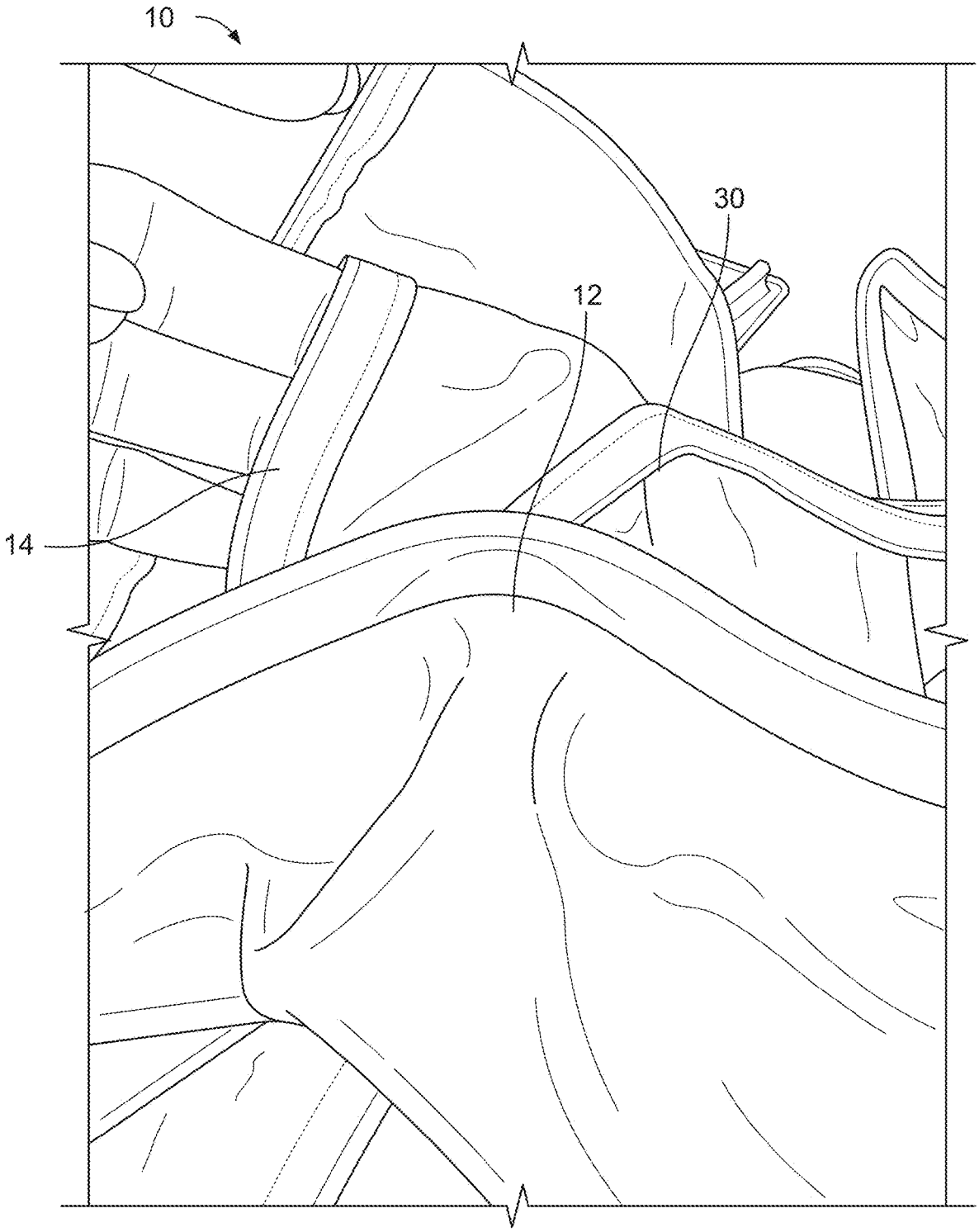
FIG. 10 is partial front perspective view of another embodiment of a wearable blanket assembly in accordance with present disclosure.

Referring to FIGS. 2, 3, 5A and 6, fabric 12 may be permanently attached to body suit 14 along each side 22 and 24 of garment body 16. For example, fabric 12 may be attached along each side 22 and 24 by stitching 50, 52. In alternative embodiments, the attachment mechanism may be an adhesive or iron-on. The stitching 50, 52, or other attachment mechanism, may extend along each side 22 and 24 of garment body 16 substantially between the respective arm and leg stalls. Fabric 12, optionally, may also be attached to the top end of the garment body 16 at a location adjacent the neck hole 30, such as below the neck hole 30, as shown in FIG. 4, or at the neck hole 30 or neck line, as shown in FIG. 10. For example, fabric 12 may be stitched or otherwise attached to the top end of the garment body 16 by stitching 54 or other attachment mechanism. Referring to FIGS. 1, 5A and 6, fabric 12, optionally, may also be attached to the lower end 28 of garment body 16, by for example, stitching 56 or other suitable attachment mechanism. Fabric 12 may be attached to body suit 14 so that there is excess or loose fabric in the area of the body suit 14. This provides excess fabric in the chest area for the child to grab. For example, when attaching the fabric 12 to body suit 14, the sides of the fabric may be moved inward a selected amount and the bottom of the blanket may be moved upward on the body suit 14. This allows some play in the fabric in the chest area. In alternative embodiments, the upper end of the blanket 58 may include a teething element or pacifier.

In one method of using wearable blanket assembly 10 shown in FIGS. 1-10, the upper torso of the child is inserted head first into the volume bound by garment body 16 through the openable crotch 36 in a direction toward upper end 26 of garment body 16, and the head of the child is inserted through neck-receiving opening 30 and the right and left arms of the child are inserted into right and left arm stalls 32 and 34, respectively. With the child's torso located within garment body 16, front and rear flaps 42 and 44 are attached to each other to close the crotch 36 and secure the child in the garment body 16. The child is then placed on its back, in a crib for example, with the fabric 12 of the wearable blanket assembly 10 covering the child.

Wearable blanket assembly 10 can also be worn in a car seat, baby chair, or just lying in someone's lap or the floor. Wearable blanket assembly 10 allows the child to pull the corners of fabric 12 to touch their face and feel comforted but because fabric 12 is permanently attached body suit 14, there is little or no risk of the child pulling the blanket over her/his head. While wearing wearable blanket assembly 10, the child may also be able to turn over, crawl and even walk while wearing blanket assembly 10. If the child's diaper needs to be changed, the openable crotch 36 allows for easy access. Openable crotch 36 also allows for easy removal of the blanket.

Figure 7:
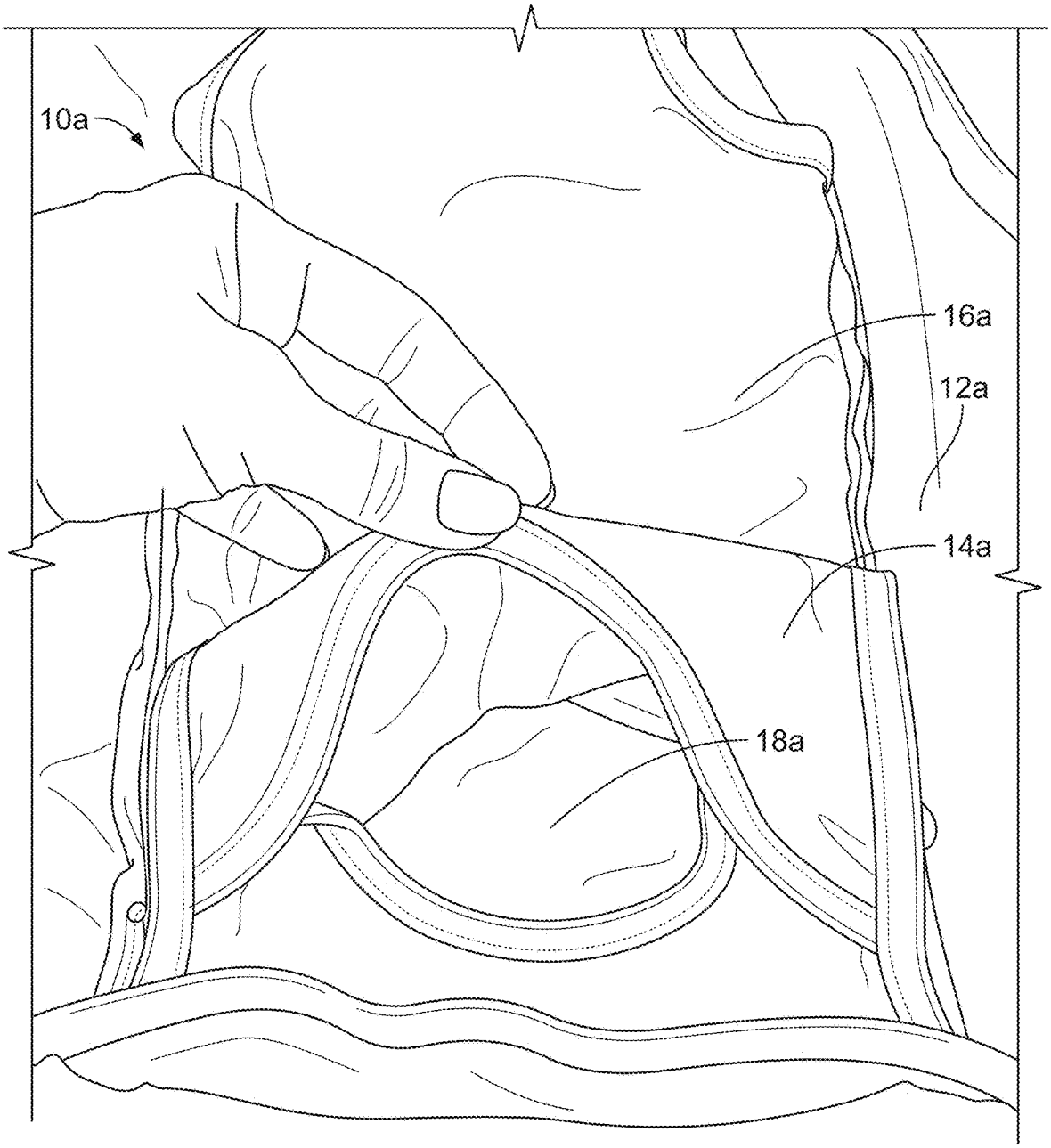
FIGS. 7-9 are perspective views of another embodiment of the wearable blanket assembly in which the front panel of the body suit is at least partially defined by the piece of fabric.
Figure 8:
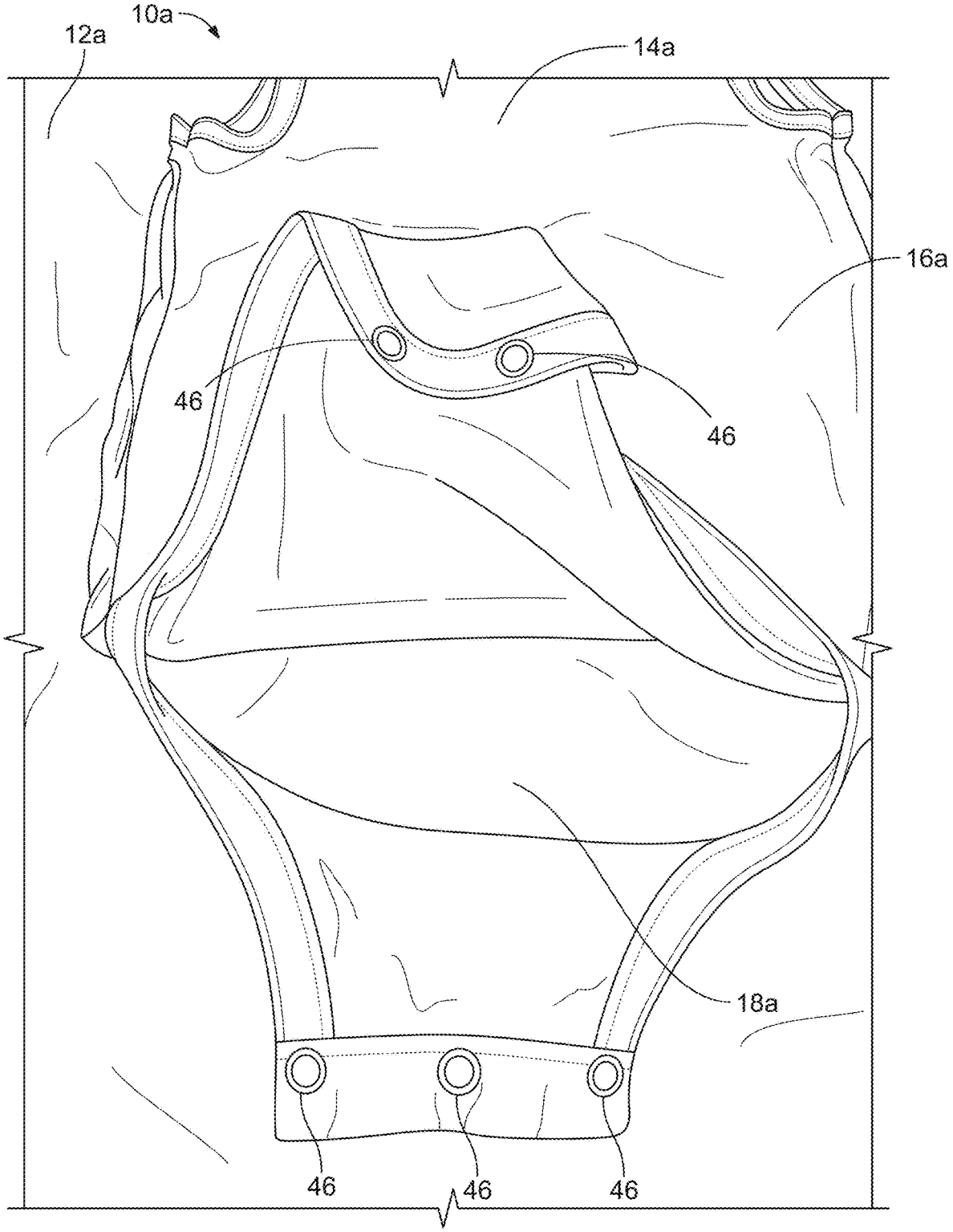
Figure 9:
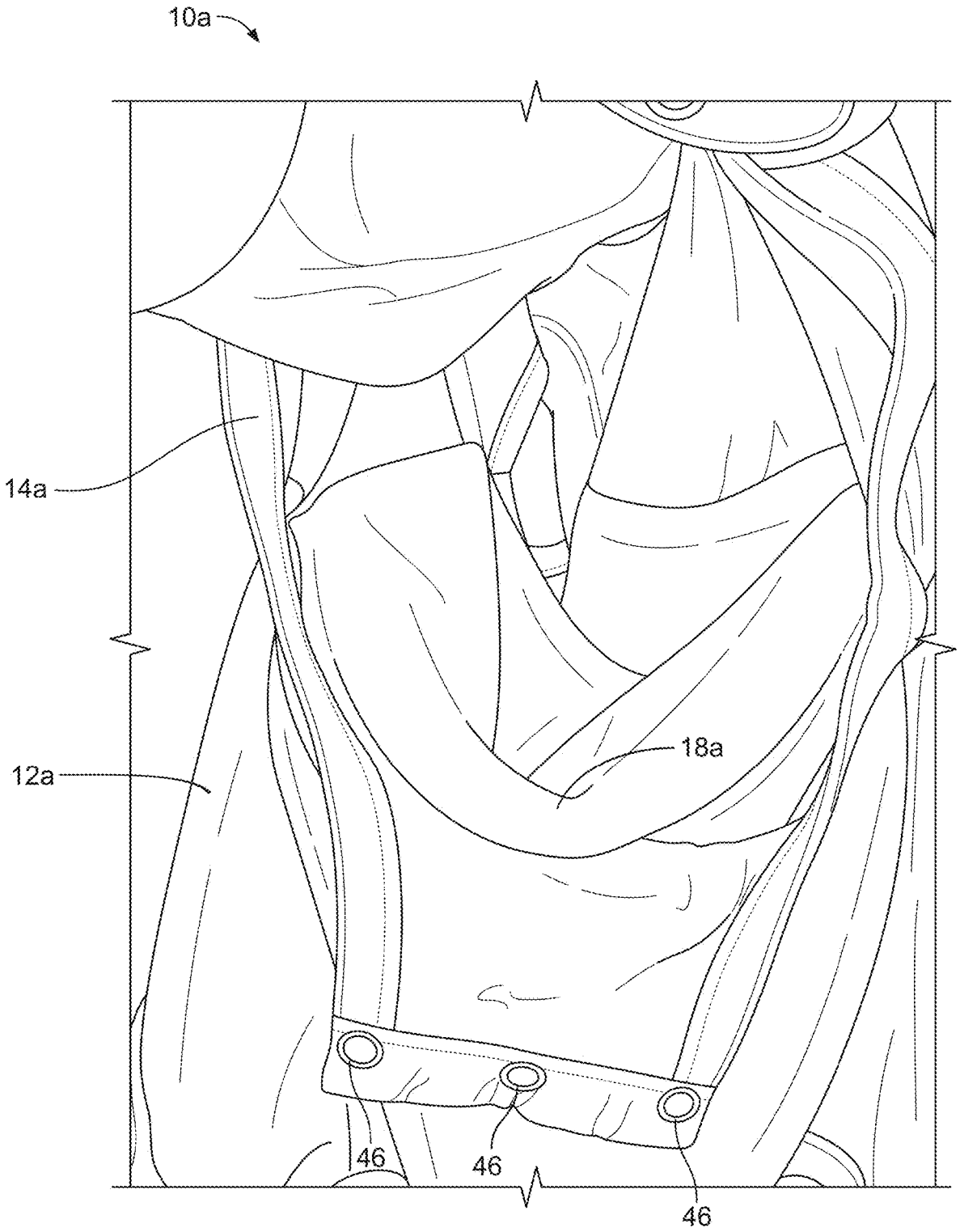

FIGS. 7-9 illustrate another embodiment of a wearable blanket assembly 10*a* in accordance with the present disclosure wherein the front or front panel 18*a* of the body garment body 16*a* is at least partially defined by fabric 12*a*. In the illustrated embodiment, the back portion of the body garment body 16*a*, including a neck hole, arm stalls, leg stalls and openable crotch with snaps therebetween, is attached to fabric 12*a*. Wearable blanket assembly 10*a* is used in substantially the same manner as wearable blanket assembly 10 and has substantially the same function.

Turning briefly to FIGS. 20A-20D, the figures illustrate a method for wrapping an infant 160 in wearable blanket 10. The method includes placing infant 160 in the body suit 14 (FIG. 2). The fabric 12 includes a first segment 162, a second segment 164, and a third segment 166. One of first and second segments 162, 164 is wrapped around one side of infant 160. For example, one of first and second segments 162, 164 is wrapped around the right side of the infant 160. Optionally, one of the first and second segments 162, 164 is secured after wrapping. The other of the first and second segments 162, 164 is wrapped around the other side of infant 160. Optionally, the other of the first and second segments 162, 164 is secured after wrapping. Optionally, third segment 166 is wrapped around the infant's feet and/or legs. The wrapping of third segment 166 may be performed before or after wrapping of first and second segments 162, 164.

Additionally, the wearable blanket assembly 10 can be customizable. As shown FIGS. 1-6, an embodiment of the wearable blanket assembly includes a plurality of attachment elements on a fabric first side 13 and a fabric second side 15. The attachment elements can be, for example, complementary female snaps 60*a*, 60*b* (FIG. 1) and male snaps 62 (FIG. 2). Of course, the placement of complementary female and male snaps can be reversed. Other attachment elements, such as buttons, hook-and-loop elements, and other attachment elements known in the art can be used without departing from the scope of the disclosure. The attachment elements can be used to attach the fabric 12 to itself or to attach auxiliary items, such as but not limited to, toys, pacifiers, bibs, and teethers. In particular, a fabric first side 13 can include pairs of female snaps 60*a* and 60*b*, each pair being located at or near the upper end of the blanket 58 and next to or near both sides of the body suit 14 (FIG. 1). A male snap 62 can be located at or near each corner on a second side 15 of the fabric 12 (FIG. 2). The number of attachment elements located on the fabric 12 can vary without departing from the scope of the disclosure.

Figure 11A:
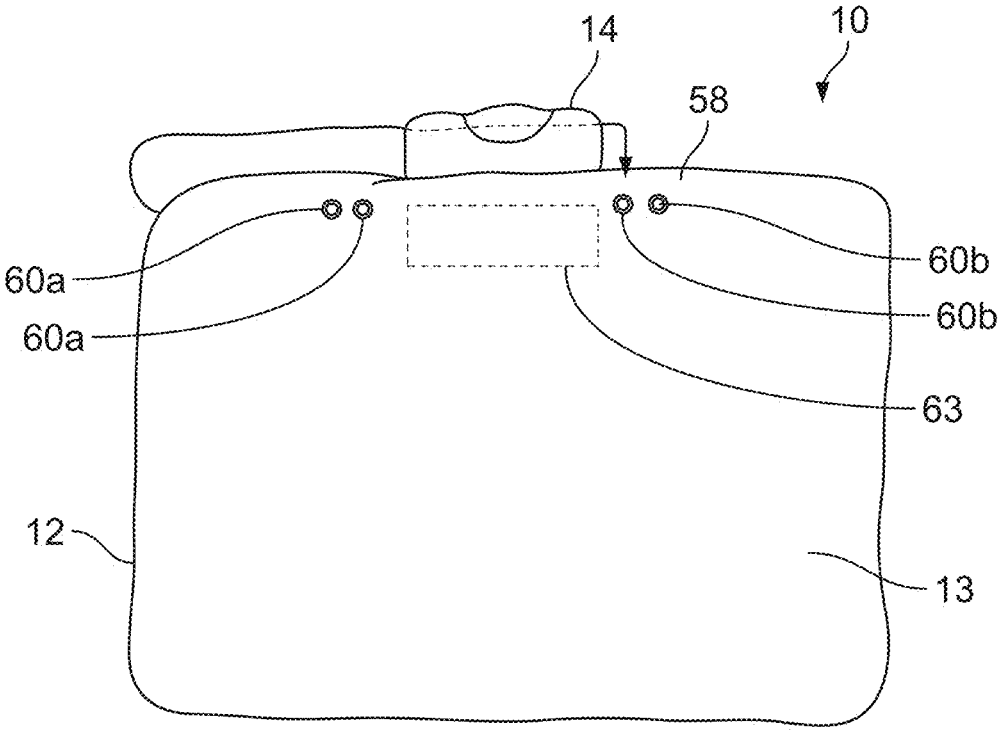
FIGS. 11A and 11B are schematic front views of an embodiment of a wearable blanket assembly with illustrative arrows showing how to place the blanket in a partially swaddled configuration.

The snaps 60*a*, 60*b*, and 62 can be used to place the customizable wearable blanket assembly 10 in a variety of configurations including various wrapped or covering configurations, such as a partially swaddled and a swaddled configuration. In one embodiment, a child wearing the blanket assembly 10 can be swaddled with the child's arms at its sides. Optionally, the customizable wearable blanket assembly 10 can include a sleeve 63 (as shown in FIG. 11A) between the body suit 14 and fabric 12 configured to hold a child's arms on its chest. In an embodiment where the body suit includes a front panel 18 that is attached to the fabric second side 15, the sleeve 63 is defined by front panel 18 and the fabric 12 and sleeve openings are defined by a gap in the stitching 50, 52 (or other attachment means). In another embodiment, the fabric second side 15 can include a sleeve 63. A child's arms may be placed within the sleeve 63 before placing the customizable wearable blanket assembly 10 in a partially swaddled or swaddled configuration.

FIGS. 11A-11D show illustrative examples of how to attach the snaps 60*a*, 60*b*, and 62 to one another to place the customizable wearable blanket assembly 10 in a swaddled configuration. Although FIGS. 11A-11D are shown without a child, it shall be understood that the blanket assembly 10 would be placed in a partially swaddled or swaddled configuration while a child was wearing the blanket assembly 10.

Figure 11B:
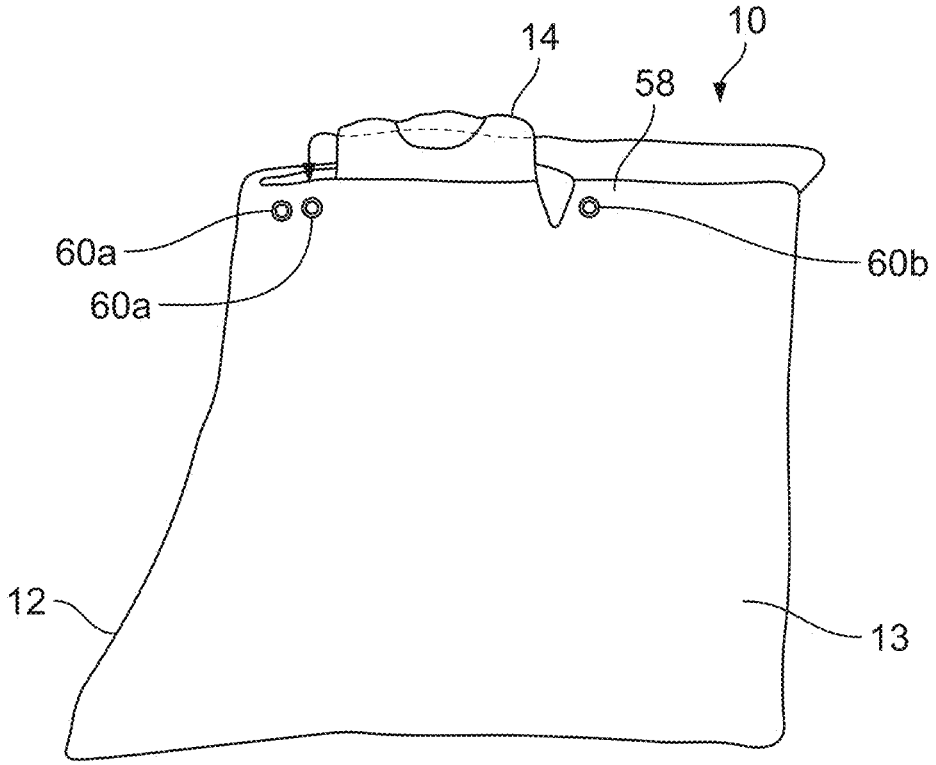

To swaddle a child wearing the blanket assembly 10 a top corner including a male snap 62 located on the fabric second side 15 is wrapped behind the child and attached to one of the female snaps 60*a* or 60*b* on an opposite side of the body suit 14. As shown in FIG. 11A, a male snap 62 is attached to one of the female snaps 60*b*. The same is then done to the remaining top corner including the male snap 62 located on the fabric second side 15. As shown in FIG. 11B, the remaining top corner male snap 62 is attached to one of the female snaps 60*a*.

Figure 11C:
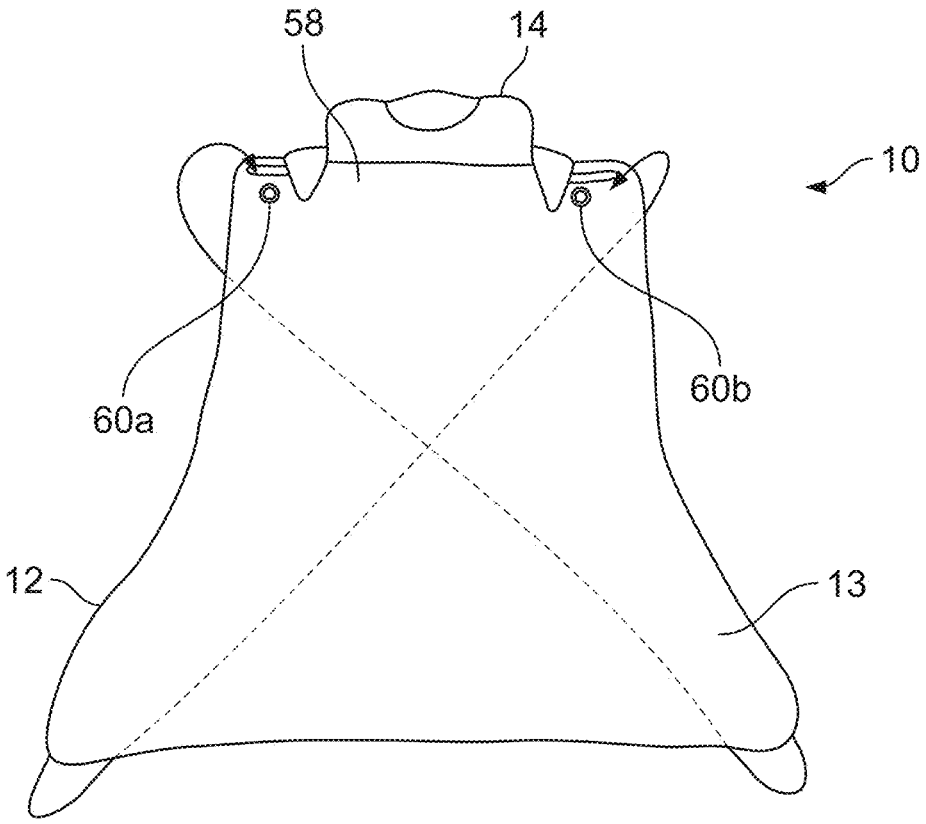
FIG. 11C is a schematic front view of the wearable blanket assembly of FIGS. 11A and 11B in a partially swaddled configuration with illustrative arrows showing how to place the blanket in a swaddled configuration.
Figure 12A:
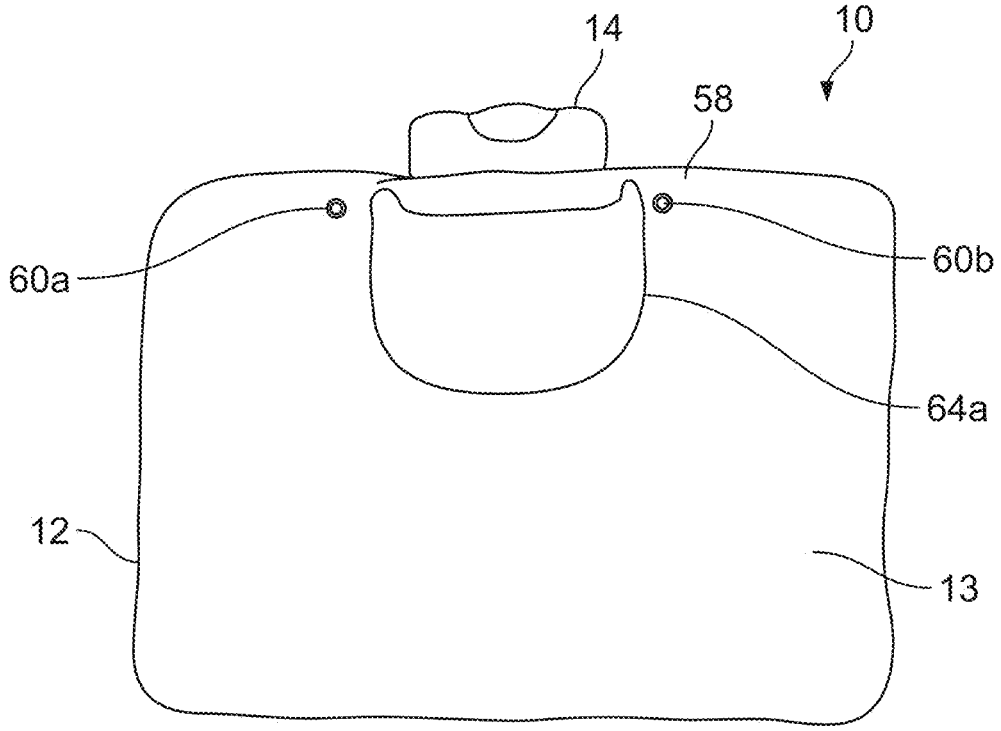
FIG. 12A is a schematic front view of an embodiment of a wearable blanket assembly in an open configuration including a bib.
Figure 12B:
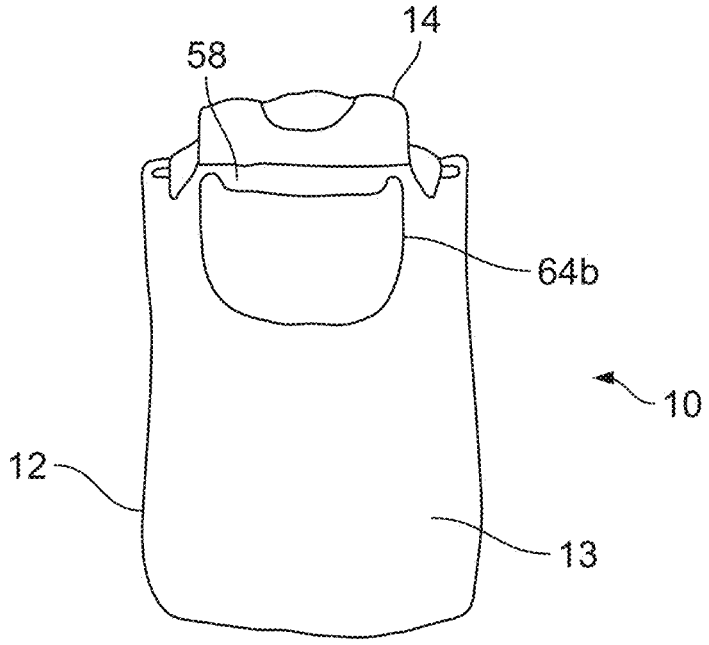
FIG. 12B is a schematic front view of an embodiment of a wearable blanket assembly in a partially swaddled configuration including a bib.

Although FIG. 11C shows the fabric 12 in a flared configuration for illustrative purposes, after the top corners of fabric 12 have been attached to female snaps 60*a* and 60*b*, the bottom of the fabric 12 may fold over itself and form a tube-like shape (as shown in FIG. 12B). The customizable wearable blanket assembly 10 can be left in this configuration if it was desired to leave the child's legs free from swaddling.

To further swaddle the child, the male snaps 62 located on the bottom corners of the fabric second side 15 can be wrapped behind the child and attached to the remaining female snaps 60*a* and 60*b* located diagonally opposite from each bottom corner. Alternatively, the male snaps 62 at the bottom corners can be wrapped behind the child and attached to a remaining female snap 60*a*, 60*b* located on the same side as the respective male snap 62.

Figure 11D:
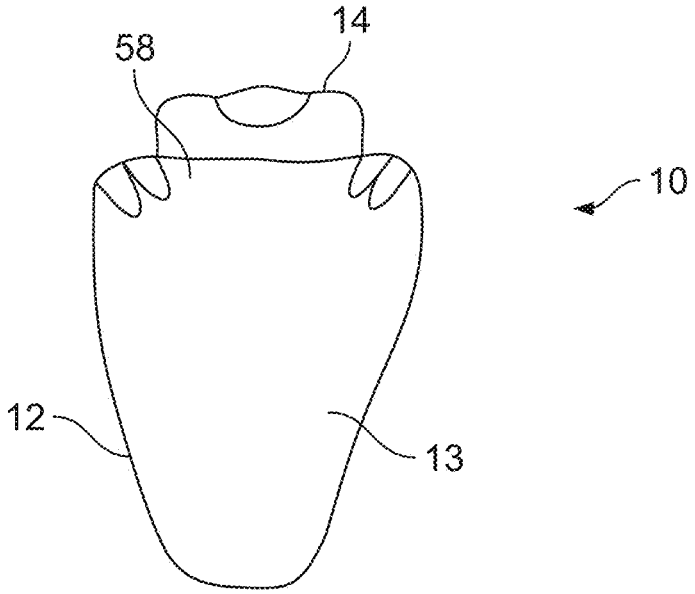
FIG. 11D is a schematic front view of the wearable blanket assembly of FIGS. 11A-11C in a swaddled configuration.

FIG. 11D shows an illustrative example of a customizable wearable blanket assembly 10 in a fully swaddled configuration. Fabric 12 of the customizable wearable blanket assembly 10 can be made of a muslin material, fleece, cotton, flannel, or other blanket-type material known in art without departing from the scope of the disclosure. In an embodiment, fabric 12 can include a cover and an insert. The cover includes a resealable opening and defines a chamber to hold the insert. The insert can include a soft and/or insulating filler. The resealable opening can be closed using buttons, snaps, a zipper, hook-and-loop elements, or other temporary closures known in the art without departing from the scope of the disclosure.

In addition to retaining the customizable wearable blanket assembly 10 in a swaddled configuration, snaps 60*a*, 60*b* and 62 can be used to attach auxiliary items 64, such as but not limited to, toys, pacifiers, bibs, and teethers to the blanket assembly 10. In an embodiment, a bib 64*a* can be attached to the snaps 60*a* and 60*b* to partially cover the fabric first side 13 at or near the child's chest. As shown in FIGS. 12A and 12B, a bib 64*a* can be snapped to the snaps 60*a* and 60*b* when the blanket assembly 10 is in an open and partially swaddled configuration. Depending on the amount of attachment elements on the fabric, a bib 64*a* may also be attached to the fabric 12 when the blanket assembly 10 is in a swaddled configuration.

Figure 14:
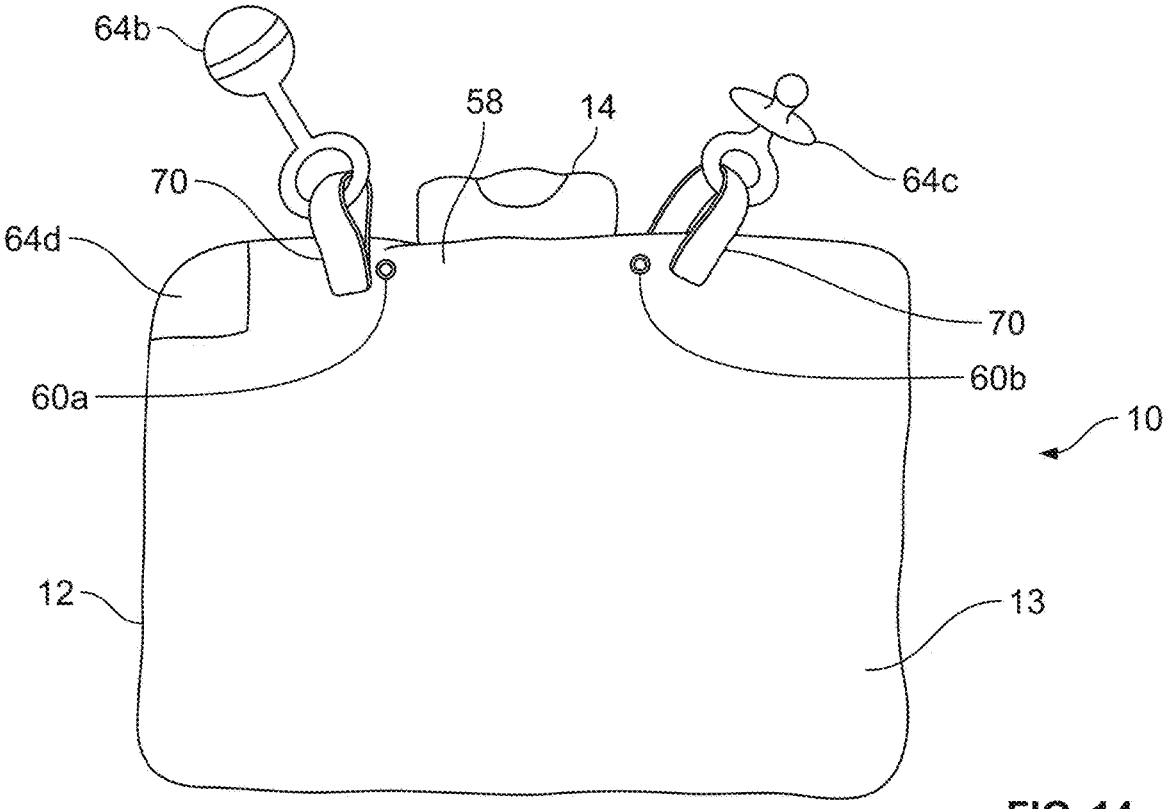
FIG. 14 is a schematic front view of an embodiment of a wearable blanket assembly including attached auxiliary items.

Referring to FIG. 14, other items such as a toy 64*b*, a pacifier 64*c*, and/or a teether 64*d* can be attached to the blanket assembly 10. FIG. 14 shows an example of a customizable wearable blanket assembly 10 including different items 64 (a toy 64*b*, a pacifier 64*c*, and a teether 64*d*) attached to it. FIG. 14 is shown as an illustrative example of the different manners in which an item 64 may be attached to the blanket assembly 10 and may or may not include each item attached in the manner shown at once.

Figure 13A:
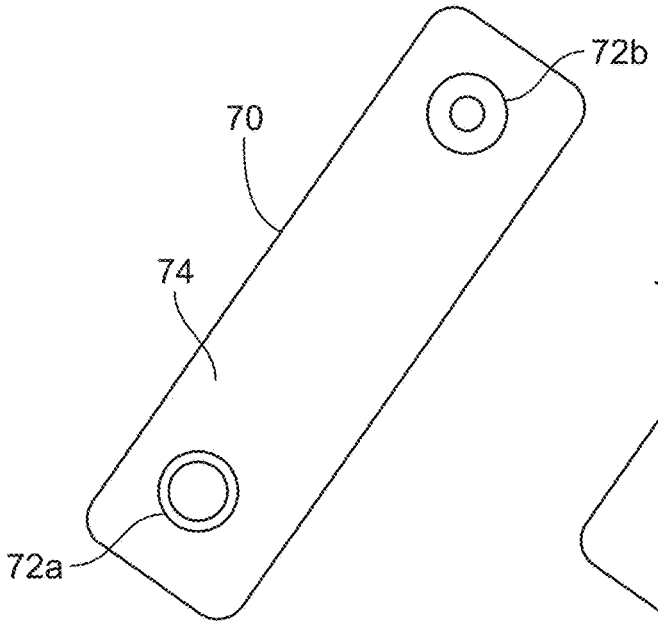
FIG. 13A is a schematic front view of an embodiment of a fabric attachment element.
Figure 13B:
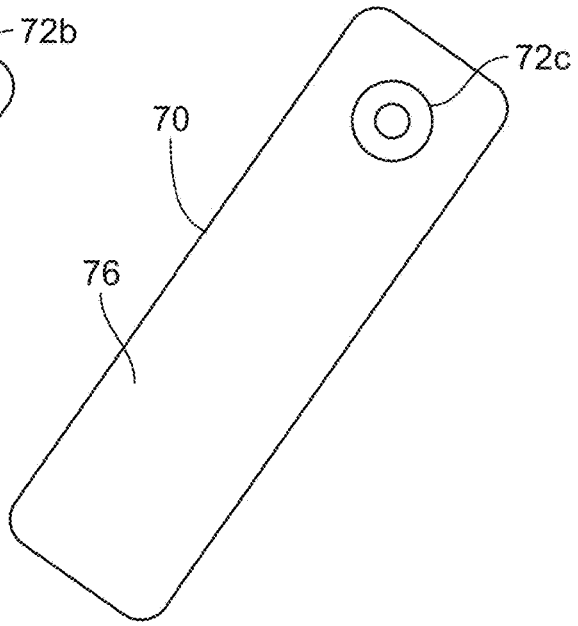
FIG. 13B is a schematic back view of the fabric attachment element of FIG. 13A.

In an embodiment, a fabric attachment strip 70, as shown in FIGS. 13A and 13B, can be used to attach an item 64 to the blanket assembly 10. Fabric attachment strip 70 can include complementary attachment elements 72*a* and 72*b* on a strip first side 74 (shown in FIG. 13A) and an optional attachment element 72*c* on a strip second side 76 (shown in FIG. 13B).

To use the fabric attachment strip 70, the strip 70 can be looped around the item 64 and attachment elements 72*a* and 72*b* can be attached to complementary attachment elements located on the blanket assembly 10. For instance, as shown in FIG. 14, a fabric attachment strip 70 is looped through a handle of a pacifier 64*c*. The attachment elements 72*a* and 72*b* on the strip first side 74 are then attached to complementary attachment elements on the fabric first side 13 and fabric second side 15.

Alternatively, if the fabric attachment strip 70 includes an optional attachment element 72*c* on the strip second side 76 (as shown in FIG. 13B), the strip 70 can be looped through an item 64 and then attached to itself using complementary attachment elements 72*a* and 72*b*. After attaching elements 72*a* and 72*b* to one another, the strip 70 and item can be attached to the blanket assembly 10 by connecting attachment element 72*c* on the strip second side 76 to a complementary attachment element on the blanket assembly 10. For instance, as shown in FIG. 14, fabric attachment strip 70 is looped through the handle of a toy 64*b* and then attached to itself using attachment elements 72*a* and 72*b*. The optional attachment element 72*c* is then used to connect the strip 70 to a complementary attachment element, such as female snap 60*a* on blanket assembly 10.

Additionally, an item 64 can be attached directly to the blanket assembly 10. In an embodiment, the item 64 can be coupled to the blanket assembly 10. The item 64 can include an attachment element configured to connect with a complementary attachment element on the blanket assembly 10. Alternatively, the item 64 can be an integral part of the blanket assembly 10. For instance, as shown in FIG. 14, a teether 64*d* can form a portion of the corner or portion of the upper end of the blanket 58, providing access to the item 64 for a child wearing the blanket assembly 10.

FIGS. 15-19B show another example of a wearable blanket assembly 100. Wearable blanket assembly 100 can include similar features as the other wearable blanket assemblies described herein. Wearable blanket assembly 100 includes a piece of fabric 112 (FIGS. 17A-17B) and a body suit 114 (FIGS. 15-16 and 18). As shown in FIGS. 15-19B, the wearable blanket assembly 100 may also be customizable by the fabric 112 being releasably attached to the body suit 114. Turning to FIGS. 15-16 and 18, the figures show examples of a body suit 114 that is configured to be releasably attached to fabric/blanket 112. For instance, fabric 112 and body suit 114 may be releasably attached by an attachment mechanism/member, such as zippers, hook-and-loop, buttons, snaps or the like. Alternatively, piece of fabric 112 can be permanently attached to one another.

Body suit 114 may include a garment body 116 that has opposed sides 122 and 124, and opposed upper and lower ends 126 and 128. Garment body 116 defines a volume to receive a child or infant.

A neck-receiving opening 130 is located in upper end 126 of garment body 116, and sleeves 133 are located at upper end 126 of garment body 116 on either side, respectively, of neck-receiving opening 130. In an example, the neck-receiving opening 130 can include a thin hem with a flatlock stitch and/or a neck binding with a single needle stitch. Additionally, the sleeves 133 can be either long or short. In particular, sleeves 133 can be long raglan sleeves, extending to the neck-receiving opening 130, as shown in FIGS. 15-16 and 18. The sleeves 133 can be attached to the garment body 116 with a flatlock stitch and can include a thin hem at the sleeve opening. In an example, the sleeve opening can include a ½ inch cuff. Of course, the sleeve 133 can include a variety of dimensions and can be attached to the garment body in any suitable way and/or with any suitable stitch without departing from the scope of the disclosure.

A crotch 136 is formed in lower end 128 of garment body 116. Optionally, garment body 116 can include a crotch gusset 146 located at the crotch 136. Crotch gusset 146 can include extra material forming the garment body 116 at the crotch 136. Crotch gusset 146 provides increased flexibility to the garment body 116 and increases comfort when wearing the body suit 114.

Pant legs 139 are located at lower end 128 of garment body 116 on either side, respectively, of crotch 136. In an example, the pant legs 139 can include a double layered foot cuff at the pant leg opening. In particular, the foot opening can include a wide double layered foot cuff. In another example, pant legs 139 can include foot coverings at the pant leg openings (i.e., the body suit 114 can resemble footie pajamas or the like). Of course, garment body 116 can be sleeveless and pantleg-less as described herein, without departing from the scope of the disclosure.

As shown in FIGS. 15-16 and 18, body suit 114 can be placed in an open and closed configuration using an openable fastener element 131. The openable fastener element 131 can be located on the front of the garment body 116. In the illustrated embodiment, openable fastener element 131 extends from the neck hole 130 in the top of body suit 114 downward toward the bottom of the body suit 114. For example, openable fastener element 131 extends from neck hole 130 downward and into one of the leg portions 139. In one alternative, openable fastener element 131 extends to adjacent one of the leg holes (if the body suit does not include pant legs 139). In other alternatives, openable fastener element 131 may extend in any manner, direction, and length that provides a space for placing the child into and removing the child from body suit 114. The openable fastener element 131 can be one or more of a zipper, buttons, snaps, hook-and-loop strips, or any other openable fastener known in the art without departing from the scope of the disclosure.

As shown in FIGS. 15 and 18, openable fastener element 131 can be at least one zipper. In an example, the zipper can be a two-way nylon zipper with two zipper pulls 143. In this instance, the body suit 114 can be opened at different locations (i.e., at the bottom or top of the body suit 114) to open a portion of the body suit 114. The zipper can include a protective zipper cover 145 located at the neck-receiving opening 130 and/or at the opposite end of the zipper (e.g., at one of the pant legs 139 or one of leg stalls 38, 40).

When garment body 116 includes a fastener element 131 as shown in FIGS. 15-16 and 18, to use wearable blanket assembly 100, a child can be placed into the garment body 116 when the openable fastener element 131 is in an open configuration. After the child has been placed within the garment body 116, the openable fastener element 131 can be placed in a closed configuration such that the child wears body suit 114.

Figure 17A:
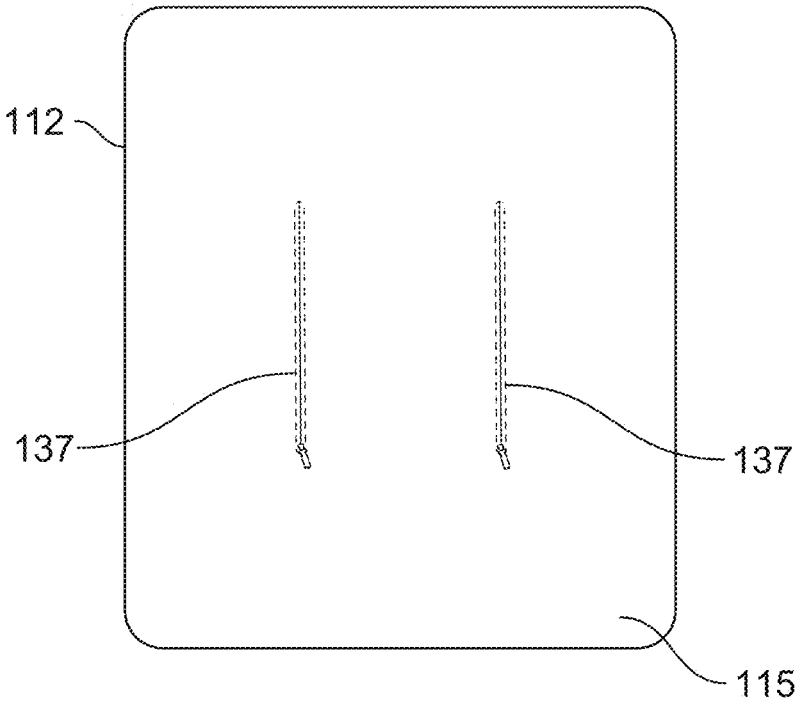
FIG. 17A is a rear view of an embodiment of a blanket.
Figure 17B:
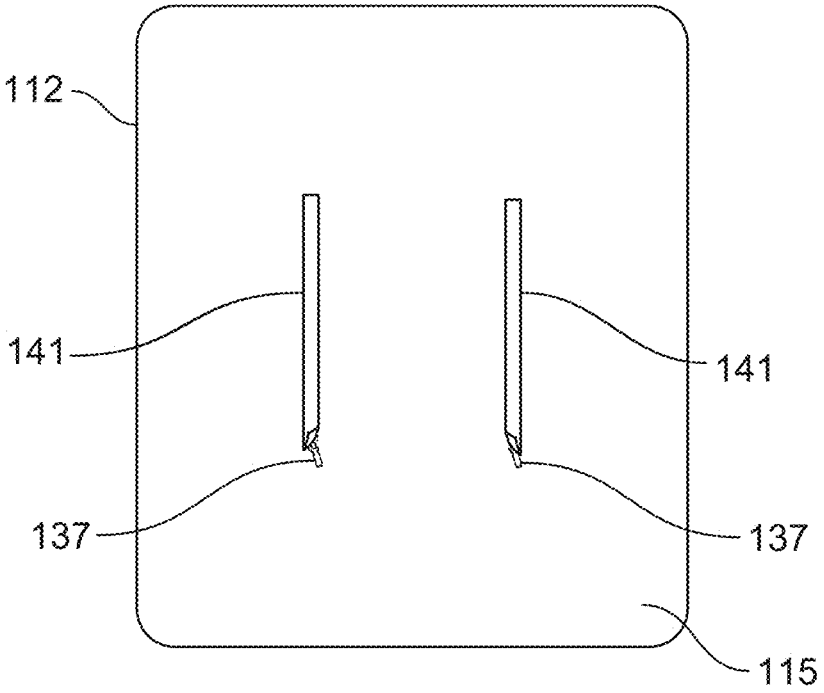
FIG. 17B is a rear view of another embodiment of a blanket.

In addition to the features of body suit 114 described above, body suit 114 can include body suit coupling elements 135 (FIGS. 15 and 18) configured to be coupled to a complementary coupling element 137 (FIGS. 17A and 17B) located on the fabric second side 115 of fabric/blanket 112. For example, the front of garment body 116 can include coupling element 135, such as a strip of zipper teeth, located at the opposed sides 122 and 124. The coupling elements extend longitudinally along sides 122 and 124. As shown in FIGS. 17A and 17B, fabric second side 115 of fabric 112 can include complementary coupling elements 137, such as a strip of zipper teeth, configured to couple to the zipper teeth of the body suit 114. A zipper slider/pull configured to couple the complementary zipper teeth together can be located on either the zipper teeth of the body suit 114 or of the fabric 112. Alternatively, the complementary coupling elements 135 and 137 can be other complementary coupling elements, such as, but not limited to snaps, buttons, hook-and-loop elements, or any other suitable complementary coupling elements.

Additionally, in some embodiments, the body suit 114 can include protective flaps 141 (FIGS. 16, 17B, and 18). Protective flaps 141 can cover any fasteners (such as openable fastener 131) and/or coupling elements (such as coupling elements 135 and 137). In an example, the protective flaps 141 can be a jersey cotton/fabric covering. The protective flap can be made of a variety of material without departing from the scope of the disclosure. By covering any fasteners or coupling elements, they may be hidden and inaccessible to a child wearing the body suit 114. In an embodiment, protective flaps 141 can be a single flap attached to the body suit 114 at one side of the fastener or coupling element. The flap has a width configured to cover the entirety of the fastener or coupling element. In the illustrated embodiment, flaps 141 extend the longitudinal length of coupling elements 135. When the coupling element includes a plurality of coupling elements or intermittently spaced coupling elements, such as buttons or intermittently spaced apart hook-and-loop strips, body suit may include a plurality spaced apart flaps 141 corresponding with respective coupling elements. In another embodiment, protective flap 141 can include a two-piece flap. Each piece can be located on either side of the fastener or coupling element such that the two pieces completely cover the fastener or coupling element. In some instances, a piece of a two-piece flap can overlap the other, to further prevent a child from accessing the fastener or coupling element.

Figure 19A:
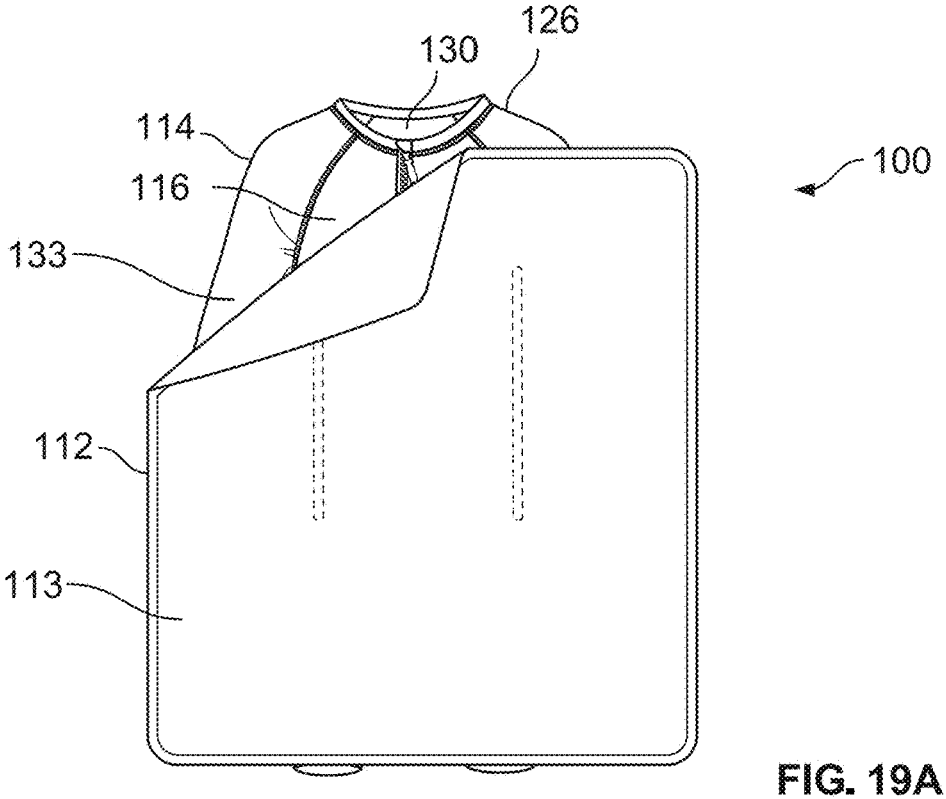
FIG. 19A is a front view of an embodiment of a body suit attached to a blanket of the present disclosure.
Figure 19B:
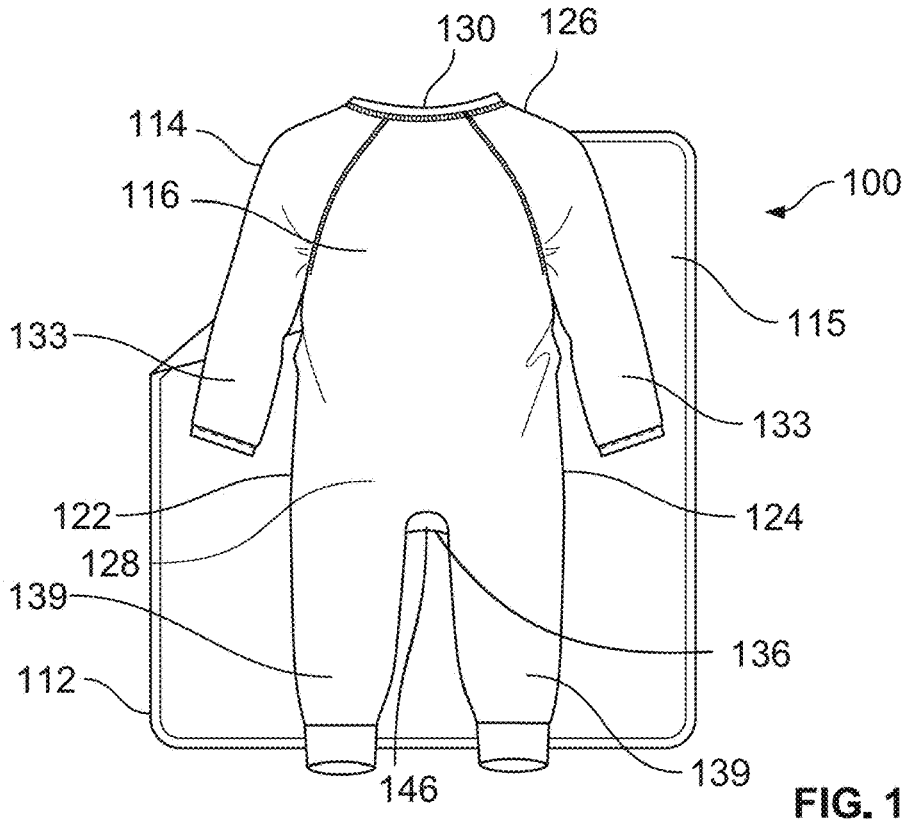
FIG. 19B is a rear view of a body suit attached to a blanket of the present disclosure.
Figure 20A:
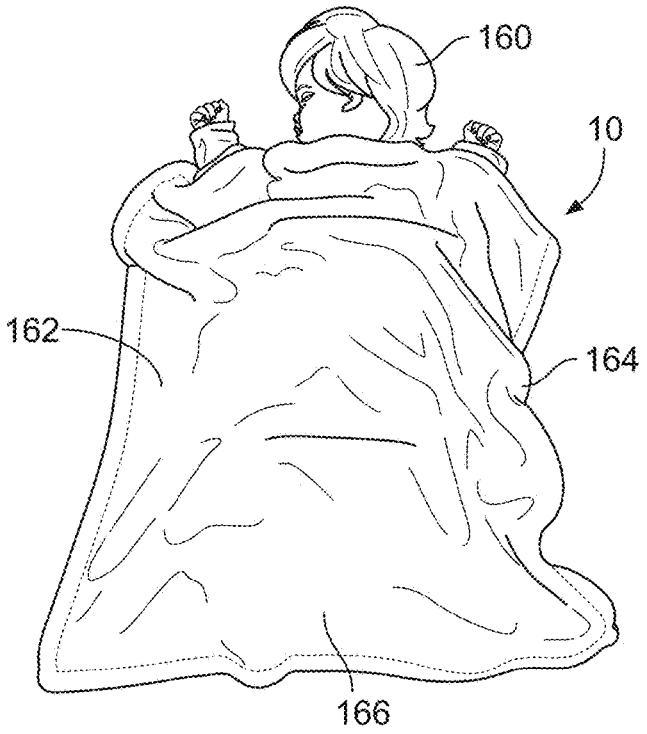
FIGS. 20A-20D are schematic illustrations of a method of wrapping an infant in a wearable blanket.
Figure 20B:
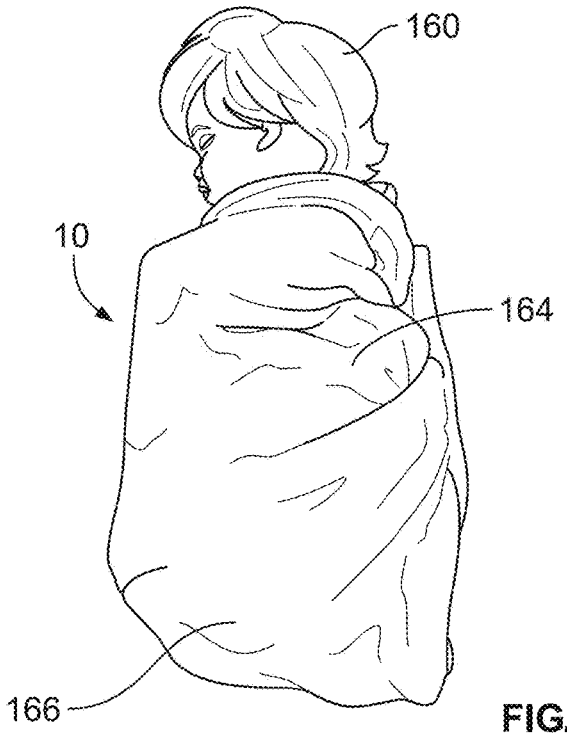
Figure 20C:
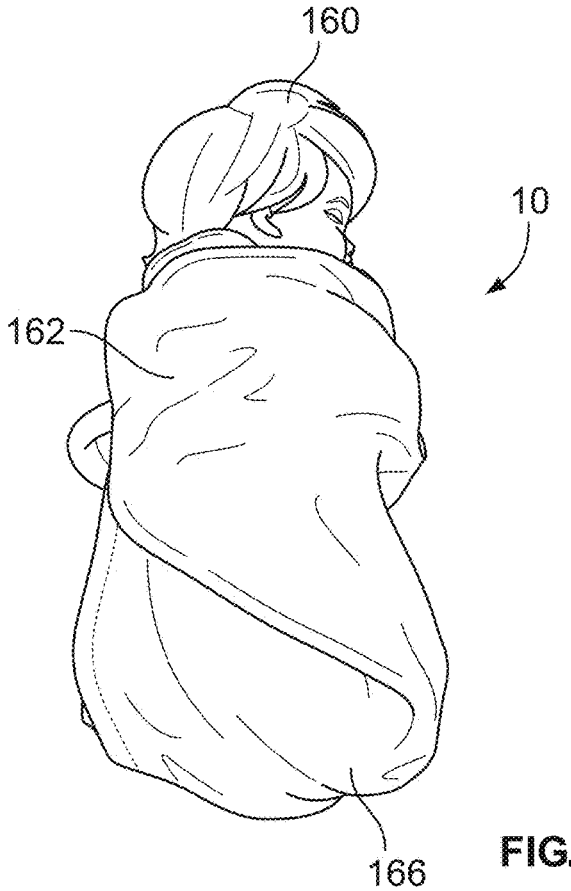
Figure 20D:
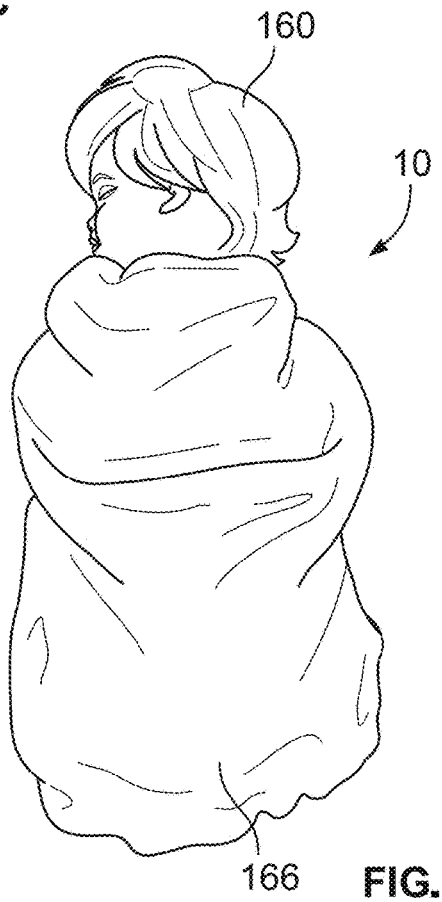

FIGS. 19A and 19B show the fabric 112 and body suit 114 in an attached configuration. Although not shown in FIGS. 19A and 19B for illustrative purposes, a child is placed into body suit 114 and fabric 112 can be attached to the body suit 114 via the complementary coupling elements 135 and 137 thereafter. As described herein, customizable wearable blanket assembly 100 can be placed in a variety of configurations. For instance, the fabric 112 can be fully attached to both coupling elements 135 located at opposed sides 122 and 124. Alternatively, the fabric 112 can be only partially attached to the body suit 114 by being attached to one of the coupling elements 135 located at either of the opposed sides 122 and 124. After being attached to the body suit 114, other auxiliary items 64 can be attached to the wearable customizable blanket assembly 100 as described herein.

In other embodiments where the child may be placed in the body suit through an opening in the rear or bottom of the body suit, the fabric 112 may be attached prior to placing the child in the body suit.

One of the benefits of the releasably attachable fabric 112 is that if the fabric becomes soiled, the fabric can be removed and replaced with a different fabric.

After a child is placed within the wearable blanket assembly 100, the wearable blanket assembly 100 can be wrapped/swaddled around the child as described herein. For instance, fabric 112 can include snaps 60*a*, 60*b*, and 62 as shown in FIGS. 1-2, and can be wrapped and secured to itself as described herein.

Although the present disclosure is described in light of the illustrated embodiments, it is understood that this is for the purposes of illustration and not limitation. Other applications, modifications or use of the wearable blanket assembly may be made without departing for the scope of this invention, as set forth in the claims now or hereafter filed.

What is claimed is:

1. A wearable blanket assembly, comprising:

a body suit including an openable fastener element configured to be opened for placing the body suit on a child;

a piece of fabric having dimensions larger than that of the body suit, the piece of fabric being releasably attached to the body suit;

wherein the body suit includes releasable coupling elements configured to be coupled to releasable coupling elements associated with the piece of fabric; and wherein the body suit further includes protective flaps covering the coupling elements of the body suit.

2. The blanket assembly of claim 1, wherein the coupling elements of the body suit and piece of fabric comprise zippers.

3. The blanket assembly of claim 1, wherein the coupling elements of the body suit comprise a pair of coupling elements extending longitudinally downward along each respective side of the body suit.

4. The blanket assembly of claim 1 wherein the piece of fabric is attached to the body suit in a manner that results in excess fabric in a front region of the body suit.

5. The blanket assembly of claim 1, wherein the piece of fabric includes attachment elements configured for holding the fabric in wrapped configuration around a child.

6. The blanket assembly of claim 5, wherein the attachment elements include first side attachment elements located at an upper end of a fabric first side.

7. The blanket assembly of claim 6, wherein the attachment elements include second side attachment elements, wherein the second side attachment elements are located at corners of a fabric second side and are configured to be attached to the first side attachment elements.

8. The blanket assembly of claim 5, wherein the attachment elements are configured to hold auxiliary items.

9. The blanket assembly of claim 8, wherein the auxiliary item is attached to the fabric using a fabric attachment strip or is directly attached to the fabric.

10. The blanket assembly of claim 8, wherein the auxiliary items include a pacifier, a toy, a bib, and/or a teether.

11. The blanket assembly of claim 5, wherein the attachment elements are snaps.

12. The blanket assembly of claim 1, wherein the fabric is configured to be held in a variety of configurations.

13. The blanket assembly of claim 1, wherein the fabric includes a cover with a resealable opening and the cover defines a chamber configured to hold an insert.

14. The blanket assembly of claim 13, wherein the insert is a soft filler material.

15. The blanket assembly of claim 13, wherein the resealable opening is sealed using snaps, buttons, hook-and-loop elements, or a zipper.

16. The blanket assembly of claim 1, wherein the piece of fabric is a light-weight sheet comprising fleece, flannel, or a muslin material.

17. The blanket assembly of claim 1, wherein the piece of fabric is rectangular or round.

18. A method of wrapping an infant in a one-piece sleepwear blanket comprising a unitary body suit and a piece of fabric having dimensions larger than that of the body suit, the piece of fabric being attached to the body suit, the method comprising:

placing the infant in the body suit, wherein the body suit includes releasable coupling elements associated with the piece of fabric and protective flaps covering the coupling elements of the body suit;

wrapping a first segment of the piece of fabric around one of a right side and a left side of the infant; and wrapping a second segment of the piece of fabric around the other of the right side and the left side of the infant, thereby wrapping the infant.

19. The method of claim 18, wherein the first segment of the piece of fabric is secured to a first portion of the piece of fabric and the second segment of the piece of fabric is secured to a second portion of the piece of fabric.

20. The method of claim 18, including wrapping a third segment of the piece of fabric around one or both of the legs or feet of the infant.

* * * * *